United States Patent [19]

Ouwenga

[11] Patent Number: 4,726,198

[45] Date of Patent: Feb. 23, 1988

[54] CENTRIFUGAL HEAT EXCHANGER

[76] Inventor: John N. Ouwenga, 148 Hampden Rd., Rochester, N.Y. 14610

[21] Appl. No.: 31,981

[22] Filed: Mar. 27, 1987

[51] Int. Cl.[4] ..... F25B 3/00

[52] U.S. Cl. ..... 62/499

[58] Field of Search ..... 62/499

[56] References Cited

U.S. PATENT DOCUMENTS

| | | | |
|---|---|---|---|
| 1,109,223 | 9/1914 | Havenstrite | 62/499 X |
| 2,979,921 | 4/1961 | Sampietro | 62/499 |
| 3,347,059 | 10/1967 | Laing | 62/499 X |
| 3,389,577 | 6/1968 | Kemp | 62/499 |
| 3,605,436 | 9/1971 | Gammill, Jr. | 62/499 X |

*Primary Examiner*—Lloyd L. King

[57] ABSTRACT

A integrated system, using one power source (M) for environmental conditioning and heat exchange or transfer, utilizing simultaneously by means of its design configuration, two physical laws of rotating mechanics embodied in the rotating member of which one is centrifugal force, to provide multiple stages of refrigerant compressing (66, 68), (72*c*, 74*c*), (82*c*, 84*c*), which is the circulating medium by which heat is exchanged or transfered from a conditioned environment to a heat sink environment through the hermetically sealed conically helical fistulous (72, 74), (82, 84) and fabricated (86), (64) environment, thus intercoursing heat from the expansion chamber to the condensing chamber, while at the same time utilizing the other law of physics to provide artifical currents of controlled air (88*a*, 88*b*), (80), (62) drawn from different environmental openings (50), (94*br*, 94*bl*), to pass independently through the outer expansion and inner condensing chambers, being divided by cylindrical baffles (76), (78) to keep environmental integrity, and from there returning to their respective environments through openings (94*aa*), (94*ba*), as they have also arrived through a compatible system of stationary baffles and wall impediments (52, 52*a*), (98), (94*ac*), (96), (94), (100) in the supporting member until the preset temperature control device (94*bt*), which moderates the refrigerant control devices (92*a*, 92*b*), (90), has been satisfied.

20 Claims, 30 Drawing Figures

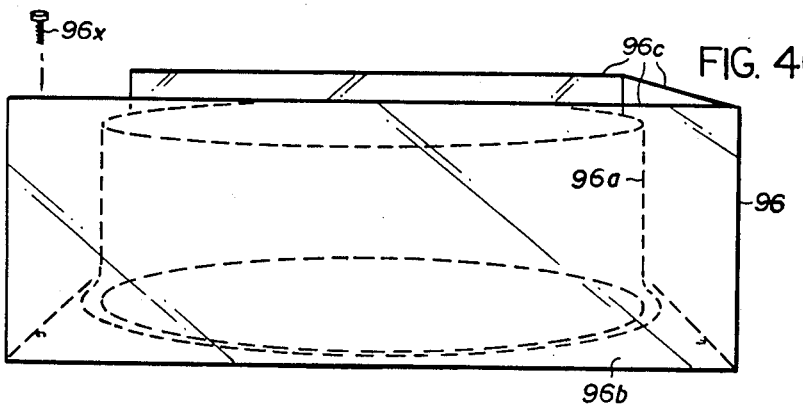
FIG. 4C
FIG. 4B
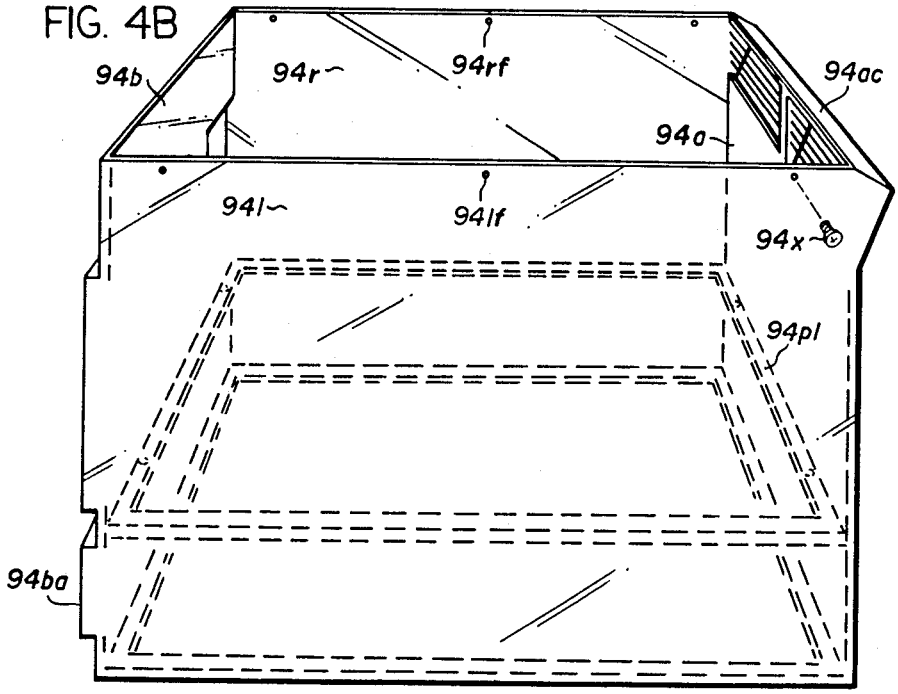
FIG. 4A
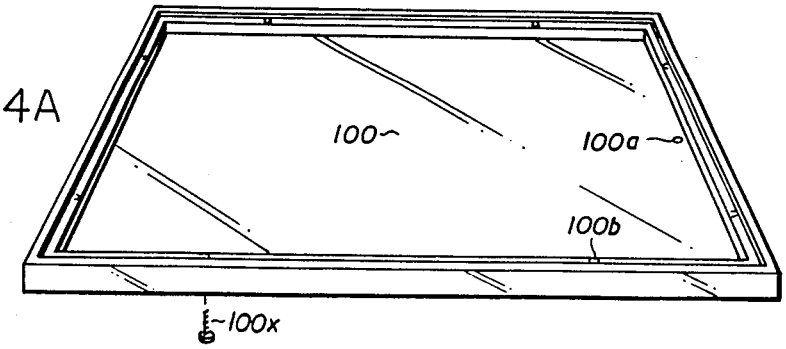

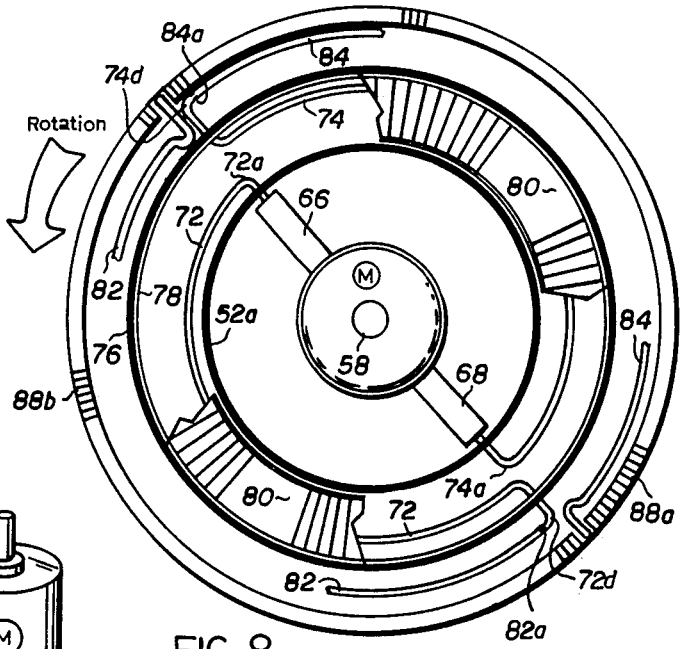
FIG. 8
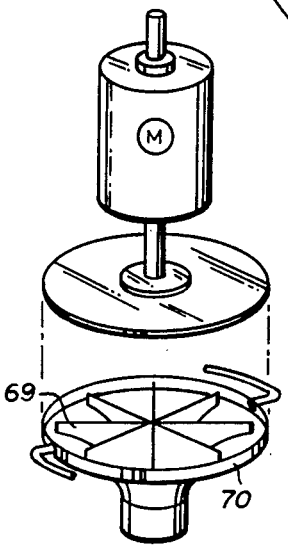
FIG. 7
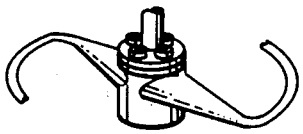
FIG. 6
FIG. 5
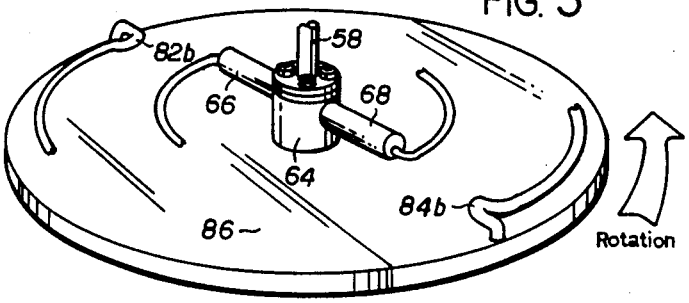

FIG. 14
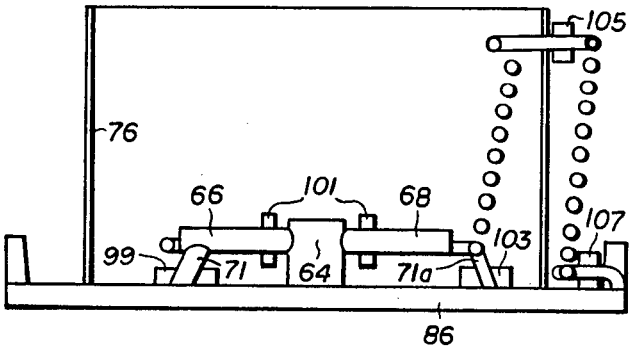
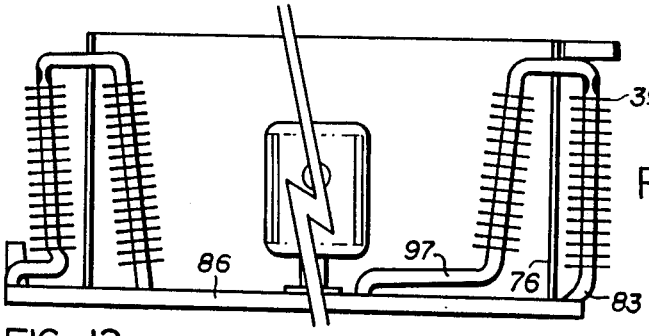
FIG. 13
FIG. 12
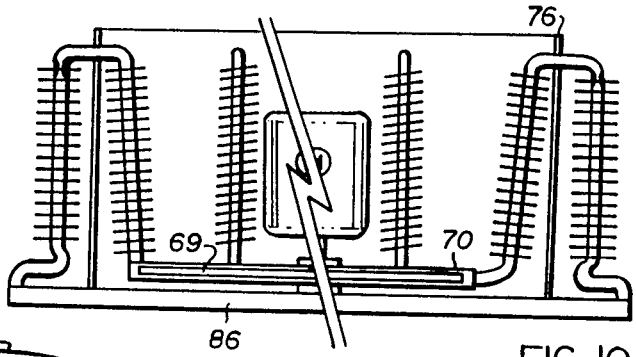
FIG. 11
FIG. 10
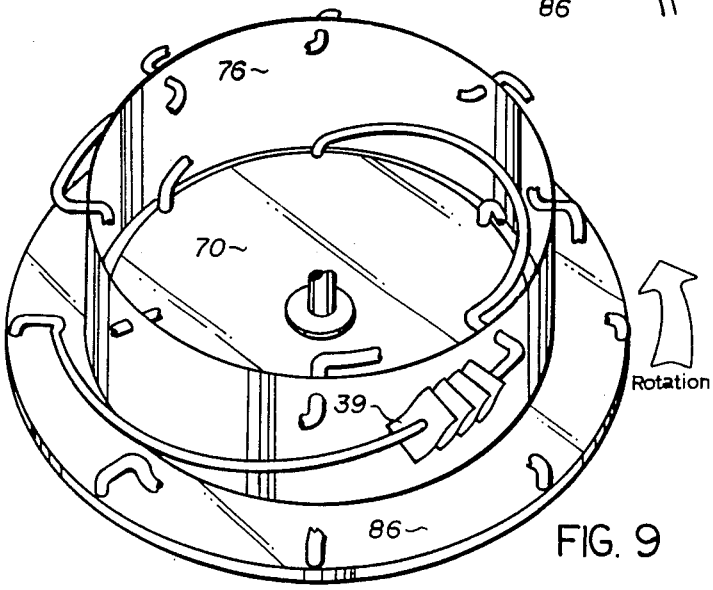
FIG. 9

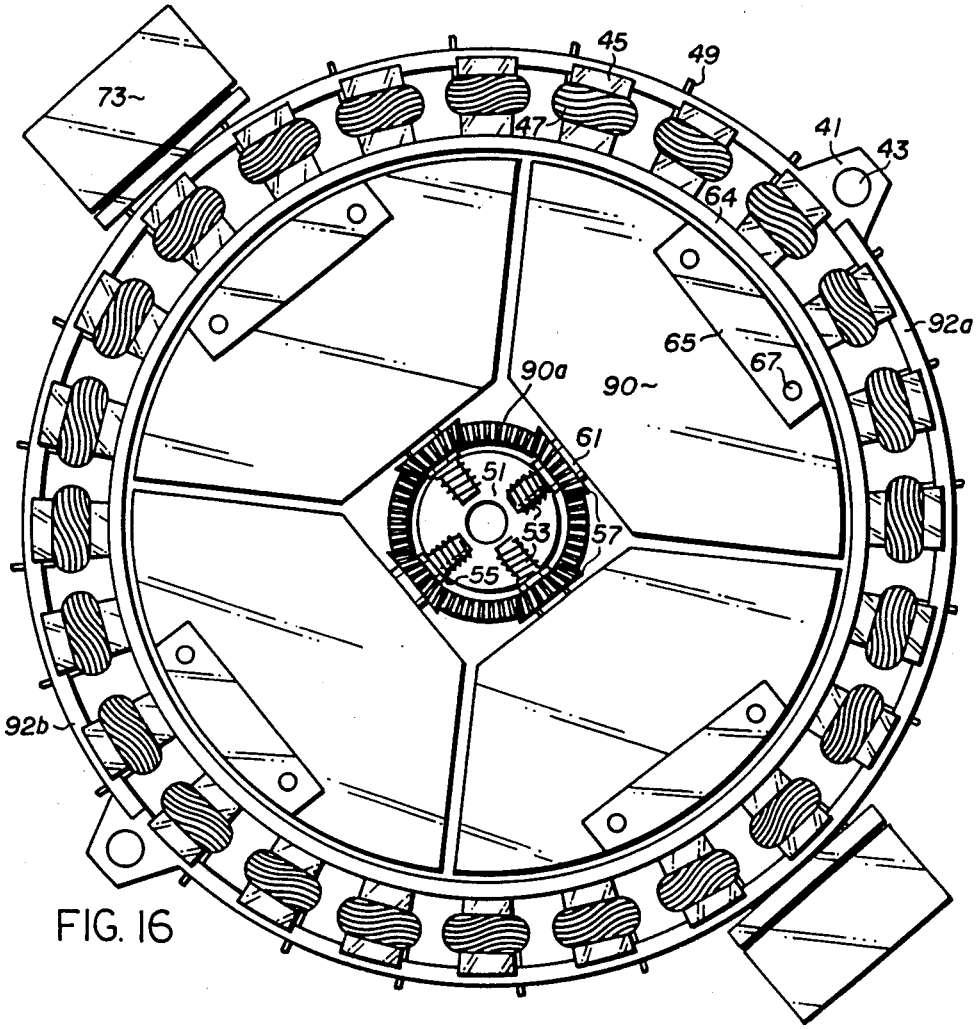
FIG. 16
FIG. 15
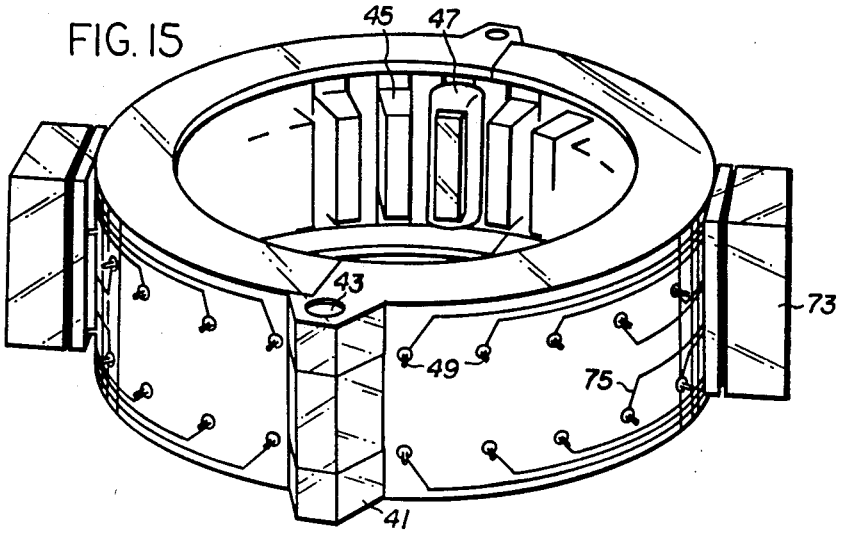

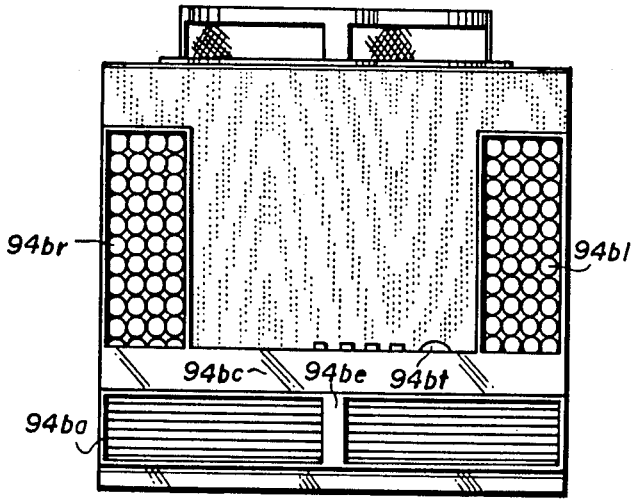
FIG. 19
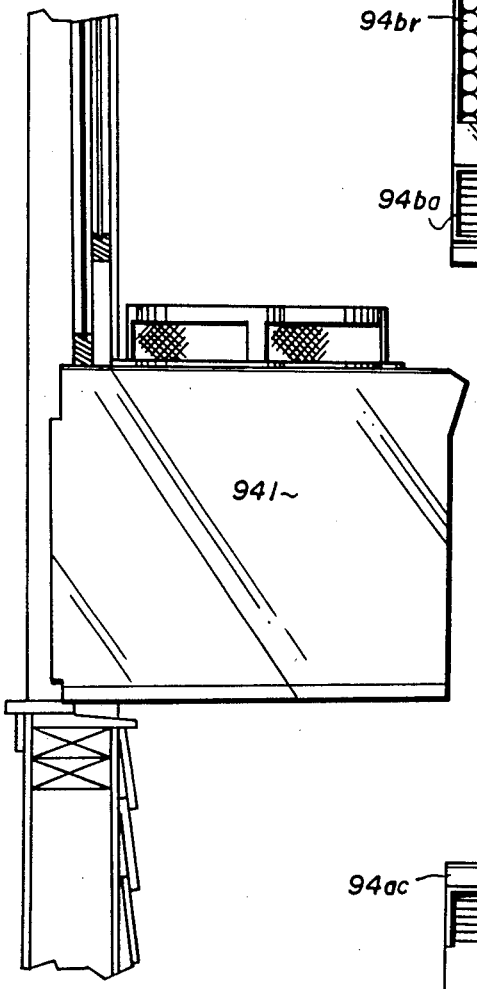
FIG. 17
FIG. 18
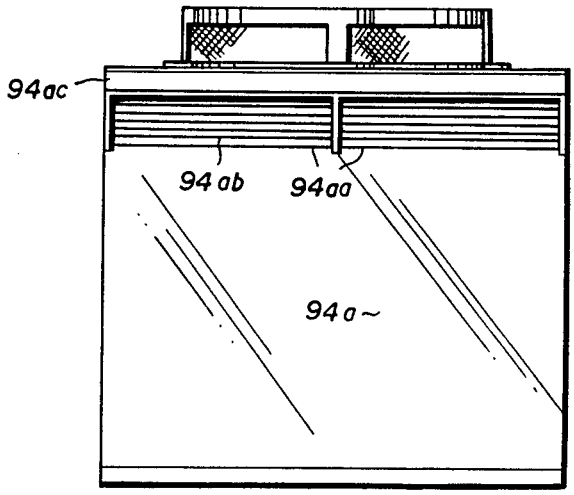

CENTRIFUGAL HEAT EXCHANGER

BACKGROUND

1. Field of Invention

This invention relates to heat exchangers in general and in particular to air conditioners, with said invention using only one power source by utilizing the centrifugal force embodied in the rotating air circulating member/s for the compression of refrigerant, thus through said utilization energy requirements need not exceed that of the air circulating member/s.

2. Description of Prior Art

Presently, in todays market place, heat exchangers using air circulation as the medium to transfer heat from one environment to another, incorporate separate power sources for the compression of refrigerant and for the circulation of air.

The disadvantage of this is that:

1. More energy must be used because of the additional compressor motor, and in cases where two blower/-fan impeller motors are used, an additional blower/-fan impeller motor.
2. More weight is necessary because of the extra motor/s and compressor.
3. More wiring is needed to control each motor/s.
4. More space is required within each unit, thereby forcing units size to be encreased.
5. More labor is required for assembly.
6. More cost is incurred because of the above mentioned reasons.

OBJECTS AND ADVANTAGES

Accordingly several objects and advantages of my invention are as follows:

(1) The primary object of the present invention is to integrate the physics of rotation mechanics embodied in the rotating member component whose design configuration allows for the utilization of centrifugal force to compress refrigerant in a hermetrically sealed environment, while at the same time using said rotation for the circulation/movement of air by means of one power source.

(2) It is the object of the present invention to rotate the condensing and expansion tubes called heat exchangers in conjunction with the multi-stage centrifugal compressors as a single unit, thus eliminating seals and the need for moving parts within the hermetrically sealed environment for its compression needs.

(3) It is also the object of the said invention that its major energy requirements need not exceed that of the rotating member component blower/fan impellers for the circulation/movement of air.

(4) It is also the object of said invention, with certain modifications in its coil configuration, to allow orientation of its rotating member components' center of rotation to be angled at any degree or fraction thereof between being right side up or upside down.

(5) Another object of said invention is to allow for greater tonnage latitude for a given power source.

(6) A further object of said invention is to provide a means to compensate for the fluctuation in temperature demands by means of a control device/s.

(7) Another object of said invention is to provide a heat exchanger unit that can be constructed with a minimum number of parts, moving or otherwise; making it more compact, easier to assemble, easier to maintain with less weight.

(8) Another object of said invention is to provide a heat exchanger unit that can at a lower cost be constructed, be purchased, be used and maintained.

(9) Further objects and advantages of my invention will become apparent from a consideration of the drawings and ensuing description of it.

DRAWING FIGURES

FIG. 4A shows the casing/cabinet bottom and tray configuration from a side elevational perspective view.

FIG. 4B shows the casing/cabinet main housing configuration from a side elevational perspective view, with phantom lines depicting supporting configuration for FIG. 4A and FIG. 4C.

FIG. 4C shows the double walled stationary baffle from a side low level elevational perspective view.

FIG. 5 shows the disk cavity support depicting tube direction with respect to rotation.

FIG. 6 shows the inner and outer condenser tube/-pipe compressor as a conical shaped tube/pipe configuration as it would be adapted to the disk cavity support shown in FIG. 5.

FIG. 7 is an exploded elevational side perspective view of a turbine compressor with motor, as it would be adapted to the disk cavity support shown in FIG. 5.

FIG. 8 is a top view of the rotating member showing tube directions of both beginnings and ending of each coil with respect to rotation.

FIG. 9 shows an elevational perspective view of the rotating member depicting a ⅓ helical turn tube configuration with fins which eliminates the need for fan/blade impellers.

FIG. 10 shows a side view of a rotating member with vertical tubes rising from disk cavity support and turbine compressor outer edge, both in cross section.

FIG. 11 shows a side cross sectional view of a rotating member same as FIG. 10 except vertical tube rise from the outer top edge of turbine compressor.

FIG. 12 shows a side cross sectional view of a rotating member with vertical condensing tube rising from disk cavity support near cylindrical baffle support.

FIG. 13 shows a side cross sectional view of a rotating member with condensing tube so arranged as to allow each condensing tube to perform as its own compressor, with the elimination of the expansion compressor.

FIG. 14 shows a side cross sectional view of a rotating member depicting various locations where control devices of either vapor or liquid refrigerant could be positioned.

FIG. 15 shows a elevational perspective view of the electromagnetic control collar device.

FIG. 16 shows a bottom view of the center tube/pipe support shown in FIG. 15 with electromagnetics exposed.

FIG. 17 shows left side view of unit in its normal position while in use.

FIG. 18 shows rear view of unit.

FIG. 19 shows front view of unit.

DRAWING REFERENCE NUMERALS

Figure 1:
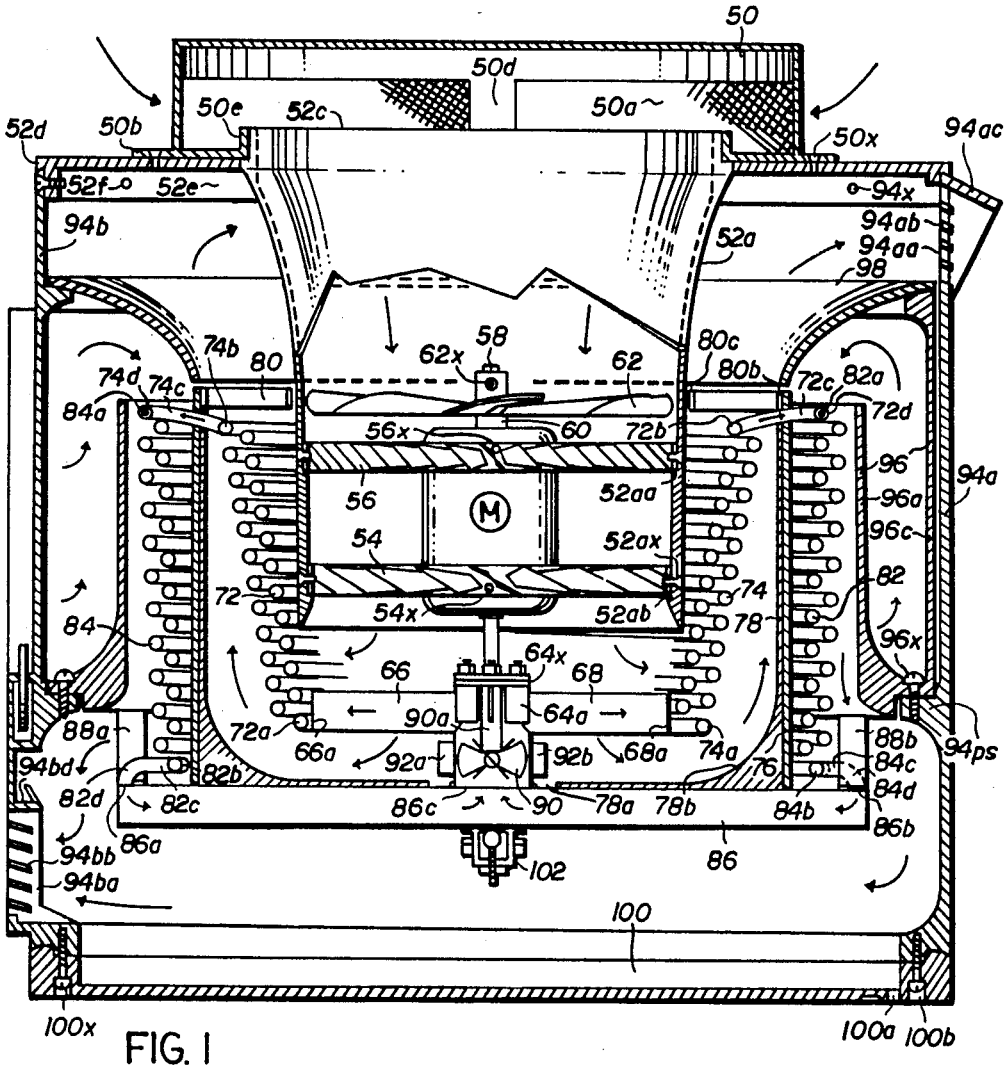
FIG. 1 is a cross sectional left side view of my invention's rotating member component, stationary baffles, and casing/cabinet; with a cut away view of the supporting assembly with power source exposed.
Figure 20:
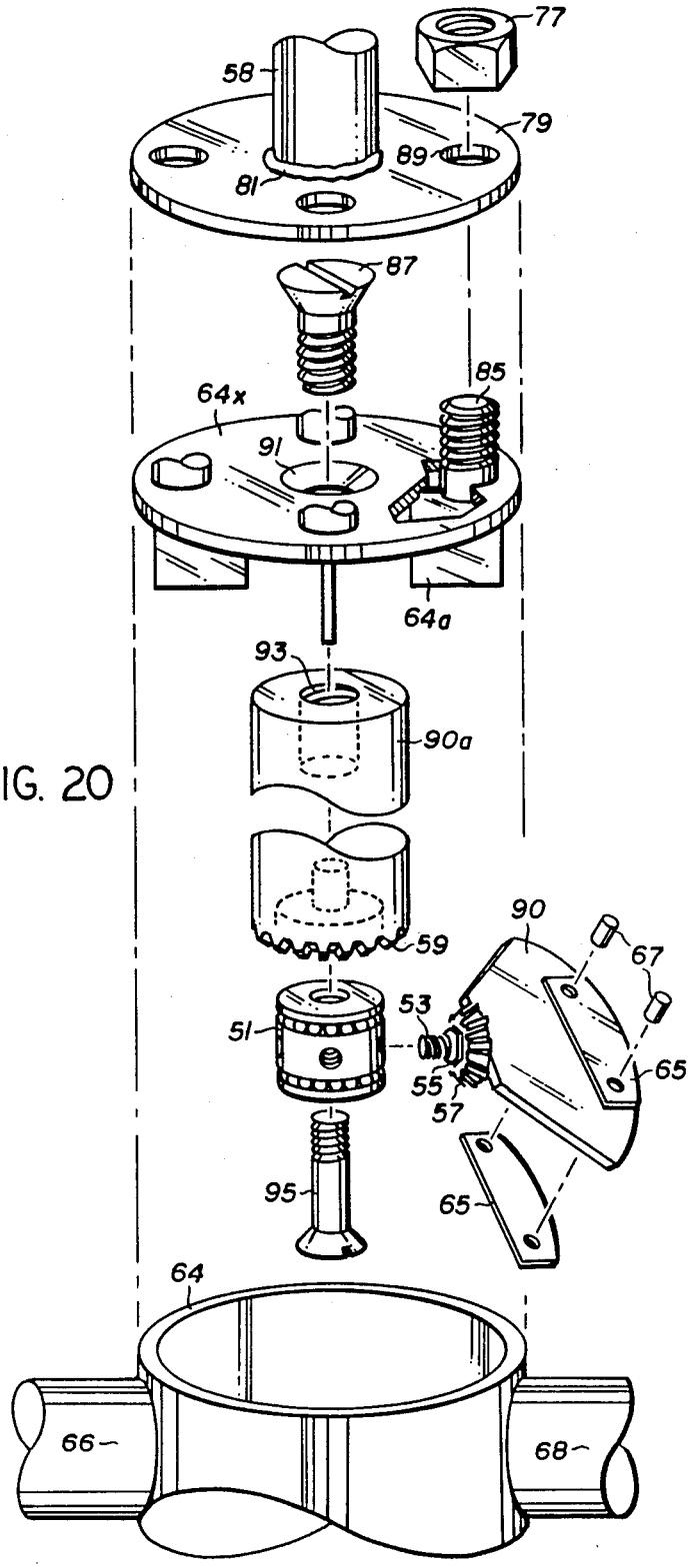
FIG. 20 shows an exploded elevational perspecitve view of the adjustable guide vane assembly and fastener device to the center tube/pipe support.
Figure 21:
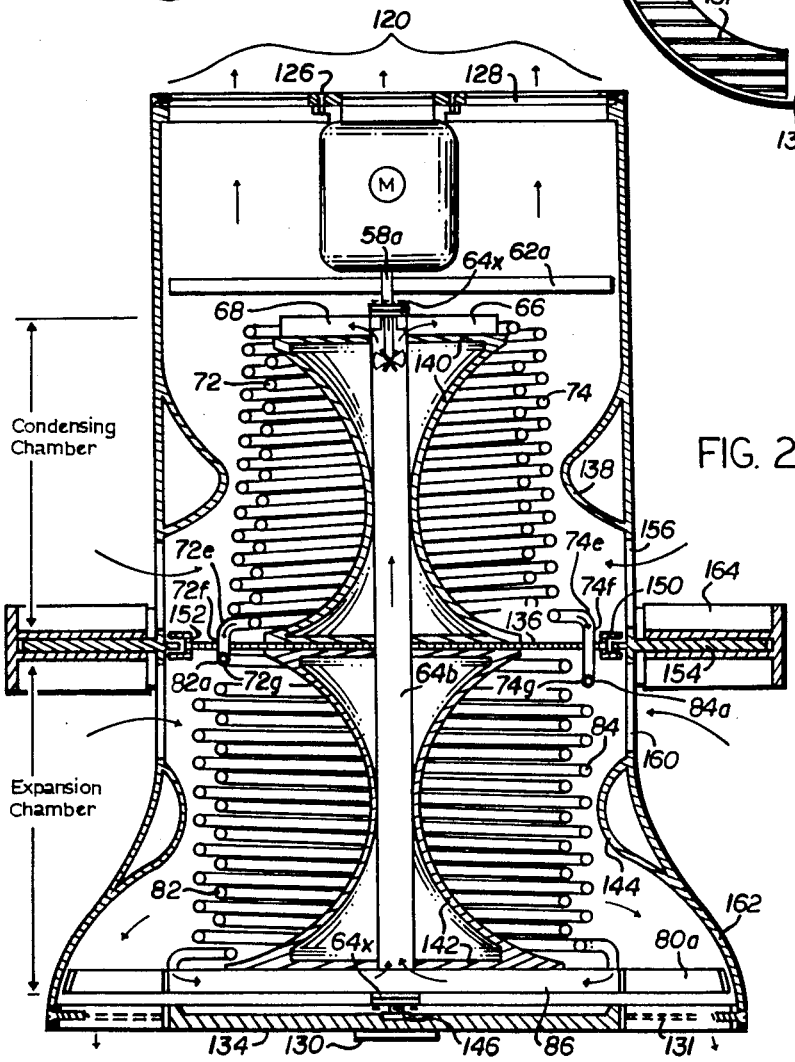
FIG. 21 shows the secondary embodiment in a top cross sectional axial view.

39 fins
41 fastener assembly
43 pin for 41
45 electromagnetics
47 windings
49 end contact of windings
50 screened cover intake shield
**50*a* screened area of 50**
**50*b* base of 50**
**50*c* holes in 50*b***
**50*x* fasteners for 50*c***
**50*d*** supports (4)
**50*e* base lip of 50*b***
51 stem bearing
52 top cover and support frame
**52*a*** intake support horn baffle
**52*b* intake opening of 52*a***
**52*c* raised lip surrounding opening 52*b***
**52*d* lip of 52**
**52*e*** cover inset area
**52*f* holes in 52*e***
**52*aa*** upper shoulder
**52*ab*** lower shoulder
**52*ax* fasteners in 52*a* for 56 and 54**
53 studs
53 lower deflective vane support motor mount
**54*a*** inner ring collar
**54*b*** outer ring collar
**54*x* fasteners for 54*a***
55 hex head shoulder of 53
56 upper deflective vane support motor mount
**56*a*** inner ring collar
**56*b*** outer ring collar
**56*x* fasteners for 56*a***
58 shaft in FIG. 1
**58*a* shaft in FIG. 21**
59 beveled gear on **90*a***
60 bearing
61 neck support of 90
62 fan blade in FIG. 1
**62*a* fan blade in FIG. 21**
**62*x* fastener for 62**
64 center tube/pipe support
**64*a*** vapor deflection vanes or impellers
**64*b* center tube/pipe support in FIG. 21**
**64*x* fastener device between 79 and 64**
65 magnetic sandwich plate of 90
66 inner coil condenser tube/pipe compressor
**66*a* small opening in end of 66**
67 fasteners for 65
68 outer coil condenser tube/pipe compressor
**68*a* small opening in end of 68**
69 impellers in FIGS. 7, 10 and 11
70 turbine compressor
71 compressor by-pass
**71*a*** coil tube by-pass
72 conically helical inner condensing coil
**72*a* elbow at beginning of 72**
**72*b* elbow at end of 72**
**72*c*** inner condensing coil orifice compressor and support member
**72*d* elbow at end of 72*c***
**72*e* elbow at end of 72*c* in FIG. 21**
**72*f* straight tube and support member following 72*e***
**72*g* elbow at end of 72*f***
73 transitor
74 conically helical outer condensing coil
**74*a* elbow at beginning of 74**
**74*b* elbow at end of 74**
**74*c*** outer condensing coil orifice compressor and support member
**74*d* elbow at end of 74*c***
**74*e* elbow at end of 74*c* of FIG. 21**
**74*f* straight tube and support member following 74*e***
**74*g* elbow end of 74*f***
75 circuit
76 cylindrical baffle support
77 nuts
78 inner liner insulation baffle
**78*a*** hole at center of bottom
**78*b*** bowl curved shape
79 end connector plate of 58
80 turbine blade type fan
**80*a* turbine blade type fan in FIG. 21**
**80*b* outer collar ring of 80**
**80*c* inner collar ring of 80**
81 weld
82 conically helical inner expansion coil
**82*a* orifice of 82**
**82*b* fluid trap of 82**
**82*c* expansion compressor of 82**
**82*d* elbow at end of 82*c***
83 vertical fluid trap in FIG. 13
84 conically helical outer expansion coil
**84*a* orifice of 84**
**84*b* fluid trap of 84**
**84*c* expansion compressor of 84**
**84*d* elbow at end of 84*c***
85 studs in FIG. 20
86 disk cavity base support
**86*a* opening at top outer edge extremities of 86 opposite 86*b***
**86*b* opening at top outer edge exremities of 86 opposite 86*a***
**86*c* opening at top and center of 86**
87 flat head machine screw
**88*a*** half squirrel cage fan blade
**88*b*** other half of squirrel cage fan blade
89 holes for studs
90 non ferrous adjustable guide vanes
**90*a*** support stem
91 tapered hole for flat head screw 87

Figure 23:
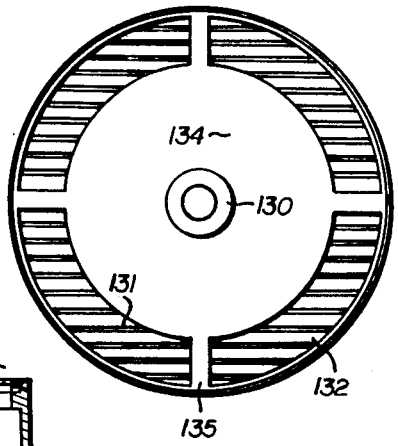
FIG. 23 shows the secondary embodiment front view.

92*a* half of electromagnetic control collar deivce
92*b* other half of the electromagnetic control collar device
93 threaded hole for 87
94 cabinet or casing
94*a* backside of 94
94*aa* twin opening at top of 94*a*
94*ab* deflector louvers in 94*aa*
94*ac* hood shield over 94*aa*
94*b* front of 94
94*ba* twin exhaust opening near bottom of 94*b*
94*bb* deflector louvers in 94*ba*
94*bc* control panel
94*bd* gutter
94*be* center drain channel
94*bl* left intake opening in 94*b*
94*br* right intake opening in 94*b*
94*bt* thermostat device
94*l* left side of 94
94*lf* fastener holes in 94*l*
94*pl* protruding ledge base support for 96
94*r* right side of 94
94*rf* fastener holes in 94*r*
94*x fasteners*
95 flat head long shoulder machine screw
96 double walled stationary baffle
96*a* cylindrical baffle
96*b* flat mediating surface between 96*a* and 96*c*
96*c* three outer rectangular wall baffle
96*x* fasteners for 96
97 independent tube compressor
98 horn ring baffle cover
98*x* fastener for 98
99 placement of by-pass vapor control device below 66 and 68
100 bottom pan/tray base
100*a* drain hole in 100
100*b* fastener holes in 100
100*x* fasteners for 100
101 placement of vapor control device on 66 and 68
102 recharging device
103 secondary placement of by-pass control device below 72*a* and 74*a*
105 placement of fluid control device on 72*c* and 74*c*
107 placement of vapor control device on 82*c* and 84*c*
120 exhaust end of condenser
121 radial support arms (4)
122*a* top quarter/half of condenser cylinder wall
122*b* bottom quarter/half of condenser cylinder wall
122*c* top quarter/half of expansion cylinder wall
122*d* bottom quarter/half of expansion cylinder wall
124 circular mounting
126 fasteners for 124
128 louvers for 120
130 control panel in FIGS. 21 and 23
131 protection rods
132 open area
134 front panel
135 support arms
136 disk baffle divider support
138 condenser wall baffle
140 condenser hourglass baffle
142 expansion hourglass baffle
144 expansion wall baffle
146 support bearing
148 circular yoke collar support
148*x* fasteners for 148
150 outer edge fork of 136
152 openings in 150
154 environmental baffle and support
156 air intake openings for condenser chamber
158 louvers for openings 156 and 160
160 air intake openings for expansion chamber
162 horn configuration of 122*c* and 122*d*
164 expansion wall baffle

DESCRIPTION OF THE CENTRIFUGAL HEAT EXCHANGER

Figure 3:
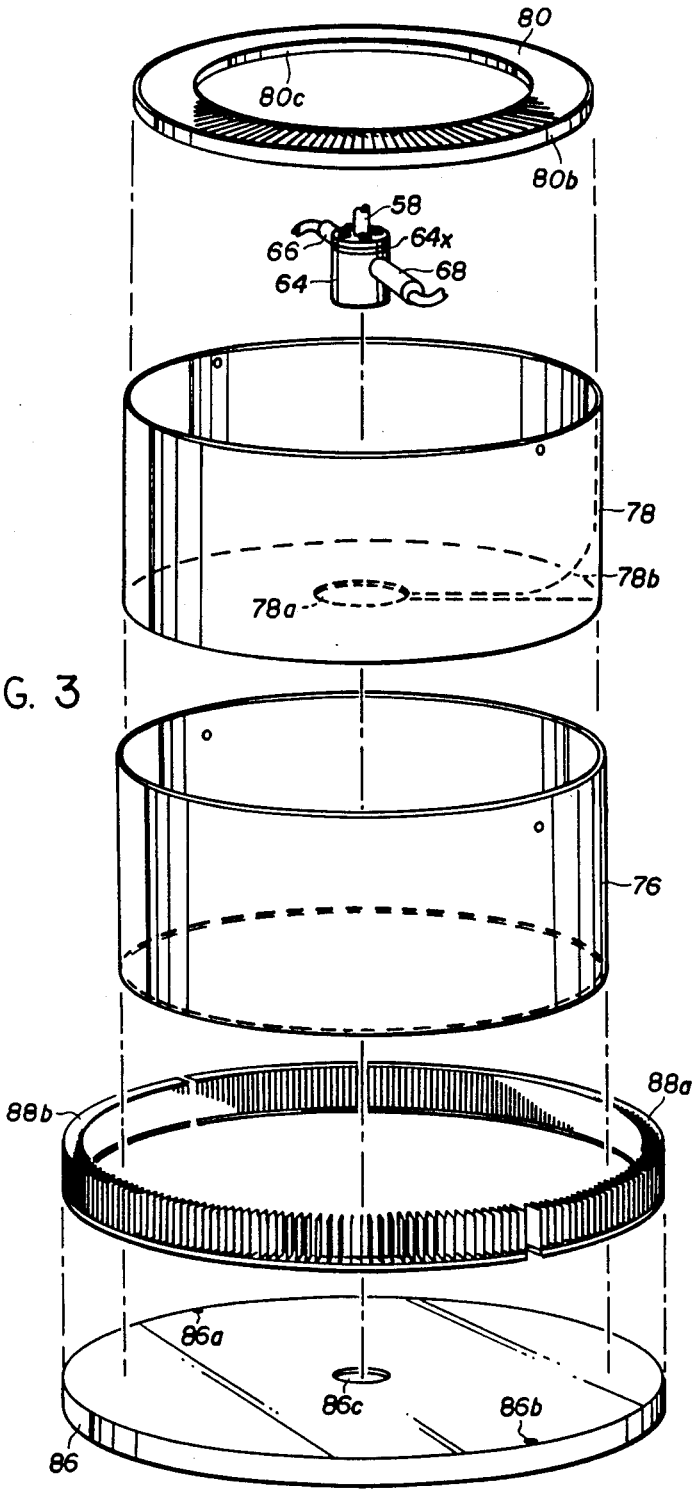
FIG. 3 is a perspective elevational exploded view showing the assembly of the rotating member component without coils and power source.
Figure 4H:
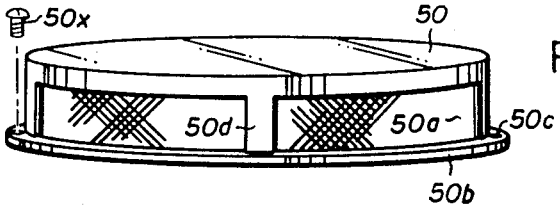
FIG. 4H shows the screened cover intake shield from a side elevational perspective view.
Figure 4G:
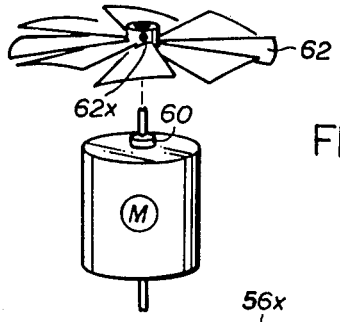
FIG. 4G shows the motor and bearing with the fan blade in an exploded view from a side elevational perspective view.
Figure 4F:
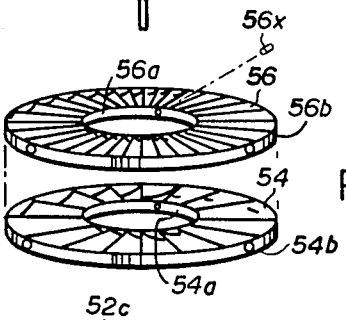
FIG. 4F shows the two deflective vane support motor mounts from a side elevational perspective view.
Figure 4E:
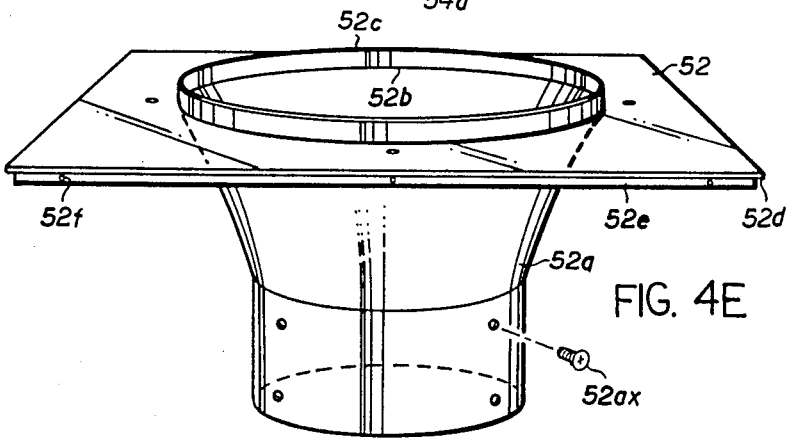
FIG. 4E shows the top cover and support frame from a side elevational perspective view.
Figure 22:
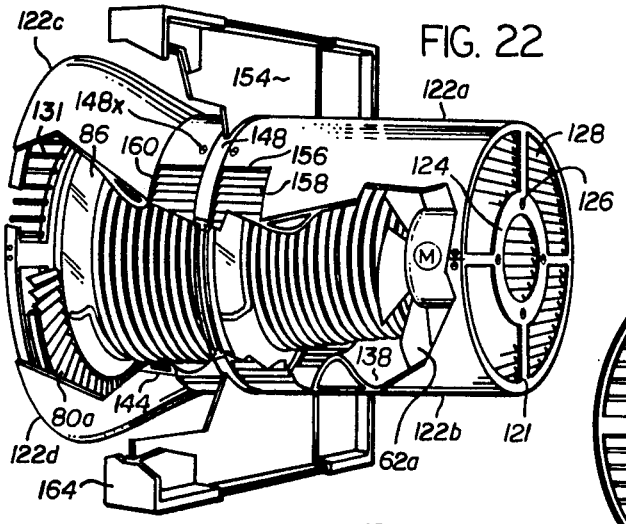
FIG. 22 shows the secondary embodiment in a ¾ perspective rear cut away view.

I will be referring to FIGS. 1 through 20 in which I have shown the preferred embodiment, and FIGS. 21 through 23 in which I have shown the secondary embodiment of my invention. At the present time to my knowledge, the material composition used in its construction are commonly available today. Beginning with FIG. 1 which is a cross sectional left side view of my invention, I will begin at the top with the screened cover intake shield 50. FIG. 4H shows said shield in perspective as a circular molded piece of a hat shape design with its brim composing the base 50*b* as a flat ring. The base 50*b* has holes 50*c* to allow fasteners 50*x* to affix the shield 50 to the top of the top cover and support frame 52. Between base 50*b* and top of shield 50 rising about ¾'s up the circular wall is an open area composed of screening 50*a* which is divided into four areas by supporting members 50*d* equally spaced. Cover shield 50 sets above with its base lip 50*e* surrounding and lying beyond the raised lip 52*c* which surrounds the opening 52*b* which is centrally located at the top of cabinet/casing top cover 52. Cover 52 inset area 52*e*, sets down below the top edge of the cabinet/casing 94 with three of its four sides having three holes 52*f* per side for fasteners 94*x* placed appropriately to secure cover 52 on its front, left and right sides, while cover 52 cover lip 52*d* rest on the top edges of cabinet/casing 94 four sides. The raised lip 52*c* as part of 52, begins the circular intake support horn 52*a*. FIG. 4E shows 52 and 52*a* as one integral piece. FIG. 1 shows the horn 52*a* descending from the top cover 52 into the cabinet/casing 94, narrowing to a smaller diameter opening until it reaches the top of the rotating member shown in perspective in FIG. 2. From there the diameter opening remains the same until shoulder 52*aa* is encountered. From there the diameter opening changes to the same size of shoulder 52*aa* until shoulder 52*ab* is encountered inches below. And from there the diameter opening changes to a yet smaller diameter comprising the shoulder 52*ab* from which the diameter begins to enlarge dropping smoothly away from center of rotation in a horn shape configuration, bring to an end the circular intake support horn baffle 52. Resting on the first or upper shoulder 52*aa* is the upper deflective vane support motor mount 56. It has a larger diameter than that of the lower deflective vane support motor mount 54, which rest on shoulder 52*ab*. As shown in FIG. 4F the motor mounts 56 and 54 comprise of an inner and outer ring collar with deflective vanes lying radially between them. The outer ring collar supports 56*b* and 54*b* rest on shoulders 52*aa* and 52*ab* respectively, which is part of the inner wall of support horn 52*a*. They are both secured in place with fasteners 52*ax*, while the inner collars 56*a* and 54*a* surrounds the motor M as its mount, being secured with fasteners 56*x* and 54*x* respectively. Mount 54 has a vane configuration greater in degree of angle deflection than that of mount 56. As also shown in FIG. 4G, the motor shaft 58 extends axially through the center of motor M with a bearing 60 surrounding it at the top, which resting on motor M has fan blade 62 resting on it. Secured to shaft 58 with fastener 62x is the fan blade 62, which keeps shaft 58 from sliding down through the motor M, thereby keeping the rotating member shown in perspective in FIG. 2 at the proper distance from the horn ring baffle cover 98. Descending through and below the motor M, the shaft 58 is attached to a circular end plate 79 by a weld 81. The complexity of FIGS. 15. 16 and 20 are shown and described as only a suggested method of handling vapor control and not to be contrued as the main purpose of this patent application. FIG. 20 shows an exploded elevational perspective view of this assembly with plate 79 having four equally spaced holes 89 penetrating its surface to provide the four studs 85 of fastener 64x to be secured by nuts like 77. Fastener device 64x studs 85 are secured in its own assembly by winged or vane heads 64a. A tapered hole 91 is placed in the center of 64x circular plate, which allows fastener 87 flat head to rest flush with the top surface of fastener 64x. Fastener 87 secures the support stem 90a to the underside of fastener 64x, by means of a threaded female hole 93 located at the end of the support stem 90a. At the other end of stem support 90a is a beveled gear 59 configuration encompassing its outer edge, with a recess area lying within the encircling gear 59 to support bearing 51. A threaded hole at center of recess area allows the fastener 95 with its matching threads after passing through the middle of bearing 51 to secure it to the recessed area. Bearing 51 has four threaded holes equally spaced around its circumference for the securing of studs 53 of the adjustable guide vanes 90. Also referring to FIG. 16, studs 53 are shown threaded with a hex head shoulder 55. Lying behind shoulder 55 is a bevel gear 57 which rotates, meshing with gear 59. Attached to bevel gear 57 is a neck support 61 which is attached to the non ferrous adjustable guide vane 90. The shape and size of vane 90 is about ¼ the size and area configuration to be controlled. At the outer edge of each guide vane 90 and centrally secured to both flat surfaces and matching the contour, are narrow magnetic sandwich plates 65 secured near their narrow ends with fasteners 67 to vane 90. So concludes the adjustable guide vane assembly. The fastener device 64x is attached and sealed to the top edge of the center tube/pipe support 64 by welding or other means, whose axis parallels the axis of shaft 58. Near fastener 64x the center tube/pipe support 64 is intersected by two smaller tubes 66 and 68 radially being horizontally perpendicular to that of center of rotation. These two tubes 66 and 68 are of the same length and symmetrically placed on opposite sides of the center tube/pipe support 64. Proceeding away perpendicular from center of axis, the tubes 66 and 68 other end are sealed except for small openings 66a and 68a respectively. From these small openings 66a and 68a, a tube proceeds straight away from it being at its point of conjunction, surrounded and attached to the openings 66a and 68a in the same manner as the intersection between the center tube/pipe support and tubes 66 and 68. The tube proceeding from the small openings 66a and 68a form elbows 72a and 74a respectively at different distances from center of rotation by the approximate diameter of the small tube. As illustrated in FIG. 8, elbows 72a and 74a elbow in direction of rotation. At the end of elbows 72a and 74a the tubes proceed around center of axis keeping an approximent equal distances from said center as it rises slightly per turn forming a conically helical coil 72 and 74 which surrounds the center of rotation with different radii. The conically helical coil 72 has a smaller turning radius starting at elbow 72a than that of coil 74 whose elbow 74a begins at a greater distance from center of rotation. Therefore coil 72 is allowed to be set inside the turning radius of coil 74 by about a distance of the diameter of the small tubes. At the end of coils 72 and 74, elbows 72b and 74b turn away from center of rotation with straight or slightly curved tubes 72c and 74c proceeding from elbows 72b and 74b. Tubes 72c and 74c pass through and are attached near the top edge of the cylindrcal baffle support 76 opposite of one another. Refering to FIG. 3 which is a perspective elevational exploded view showing the assembly of the rotating member component without coils and power source, baffle support 76 is shown as being attached to the disk cavity support 86. Fitted snuggly within the support 76 cylindrical wall and resting on the top of the base support 86 surrounded by support 76 is a insulated inner liner baffle 78. The baffle 78 side wall area starts curving smoothly inward toward center of rotation about ¼ of its total wall height from the base support 86, forming a bowl shaped curved bottom 78b. At the center of the bowl shaped bottom 78, which covers the base support 86 is a large circular opening 78a. It is just large enough to allow attachment of said center support 64 to be attached to the cavity support 86 while liner baffle 78 is in place. Also setting snuggly within and flushed at the top of baffle 76 is the turbine blade type fan 80 which rest on the top edge of baffle 78, holding it in place. Baffle 78 is shorter than baffle 76 by the same thickness or depth of fan 80. Fan 80 configuration has an outer and inner ring which supports the vane impellers lying in between. The outer ring 80b has tabs around its circumference which fit into slots in the inner wall of baffle 76, which holds it in place. Fan 80 inner collar 80c lies just short of touching the outside of the intake support horn baffle 52a. After tubes 72c and 74c, which are of the same length, pass through near the top of baffle 76 and 78, they elbow at 72d and 74d to turn back counter to rotation. Immediately following elbows 72d and 74d, orifices 82a and 84a are encountered as shown more clearly in FIG. 8. Beginning from orifices 82a and 84a, the inner and outer helical coils 82 and 84 begins winding downward just out side of baffle 76 in a conically helical fashion, with each turn being incrementally closer to center of rotation than that of the last turn. The degree of conical angle from center of rotation axis, would be determined by the RPM verses distance from from center of rotation for both sets of said coils that would match the angle of fluid suspended. At the end of coils 82 and 84, a fluid trap 82b and 84b is encountered, which elbows about half the diameter of the tubes in distance towards the center of rotation; than elbows away from center of rotation forming a short straignt tube 82c and 84c perpendicular to center of rotation. At the end of tubes 82c and 84c, elbows 82d and 84b are encountered turning downward towards the outer top edge of the disk cavity base support 86, at openings 86a and 86b which surround and attach to elbows 82d and 84d. Also resting on and at the top outer edge extremenities of base support 86 are two halves of a squirrel cage type fan blade 88a and 88b. They are attached with enough space between the said halves to allow elbows 82d and 84d to be attached to the base support 86. At the center of the base support 86 is a circular opening 86c, allows the edge of said pipe support 64 open end to be attached flush with a weld. Surrounding the pipe support 64 just above the bas support 86 is the electromagnetic control collar device halved unit 92*a* and 92*b*. Referring to FIGS. 15 and 16 the two halves of the control device 92*a* and 92*b* are shown fastened together with a pin 43 running through the fastener assembly 41. Transitors 73 are attached to the outside of both halves 92*a* and 92*b* midway of fastener assemblies 41. Seated and being wedged within slots inside the collars 92*a* and 92*b* are electromagnetics 45 with their windings 47. The collars 92*a* and 92*b* press the electromagnetics 45 against the outer wall of the pipe support 64 while enclosing the electromagnetics 45 on three sides. The ends of windings 47 pass through the outer wall of collars 92*a* and 94*a* as end contacts 49 of windings 47 making contact with the circuit 75. On the opposite side of the base support 86 near and at center of rotation is attached a recharging device 102, being directly across from where the pipe support 64 is located.

Figure 2:
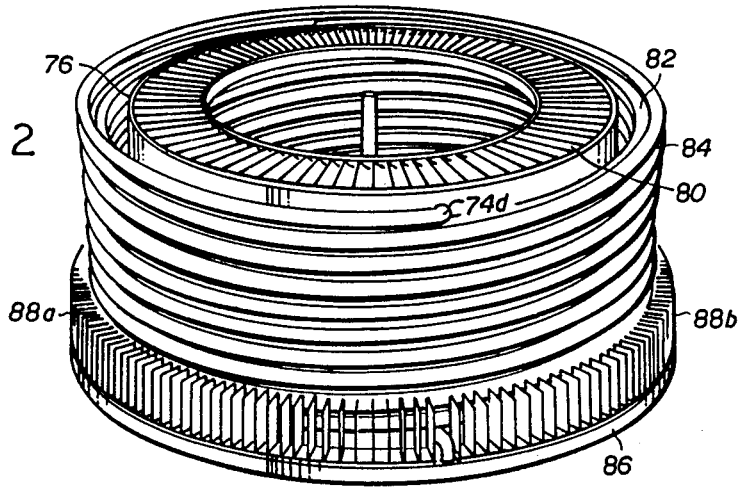
FIG. 2 is a perspective elevational view of the rotating member component.
Figure 4D:
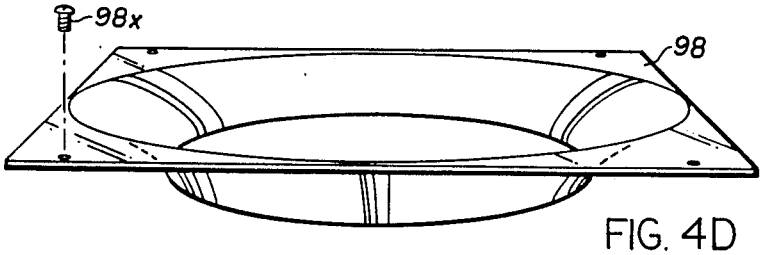
FIG. 4D shows the horn ring baffle cover from a side elevational perspective view.

Inside cabinet/casing 94 and surrounding the rotating member isolated in FIG. 2 is a double walled stationary baffle 96 which rest on protruding shelves 94*ps* from the inner wall of cabinet/casing 94. Fasteners 96*x* secures baffle 96 to shelves 94*ps*. As also shown in FIG. 4C, baffle 96 configuration has a inner cylindrical baffle 96*a* surrounding coils 82 and 84, with openings on both ends of baffle 96*a*. Attached to one of baffle 96*a* openings, on its outside edge is a flat four sided mediating surface 96*b* proceeding away from center of rotation as a brim like configuration encirculing baffle 96*a* towards a three walled rectangle box type baffle 96*c*. Baffle 96*c* encloses baffle 96*a* on three sides, with baffle 96*c* edge opposite mediating surface 96*b*, widening toward center of rotation just enough the allow for the insertion of fastener holes on its left, right and rear walls. Attached to baffle 96*c* by means of said fastener holes is a horn ring baffle cover 98 secured with fasteners 98*x* at its outer rectangle horn edge to the baffle 96*c* left and right walls. The inner circular and lower center part of the baffle 98, as shown in perspective in FIG. 4D, is positioned just above the rotating vaffle support 76.

Now to finish describing the stationary member cabinet/casing 94, I will begin by using FIG. 18 which shows the back side 94*a*. Running along the top portion of back side 94*a* are twin openings 94*aa* of rectangular shape having deflective louvers 94*ab* inset said openings with a hood shield 94*ac* sheltering it. Referring to FIG. 19, the front of the cabinet 94*b* has near its bottom edge a twin exhaust opening 94*ba* with deflector louvers 94*bb* inset it. Beginning a little above opening 94*ba* and against the right and left side edges of cabinet 94*b* are vertical rectangle openings 94*br* on the right, and 94*bl* on the left, whose total square area equals that of opening 94*ba* which lies horizontally near the bottom. A ledge comprising a control panel 94*bc*, lies across the front between openings 94*br* and 94*bl* protruding bottom edges. The cabinet 94 sides, left 94*l* and right 94*r*, are of a continuous flat surface with fastener holes 94*rf* on the right and 94*lf* on the left, located near top edge of each side, as shown in FIG. 4B. At the base of cabinet 94 is the bottom pan 100, which is attached through recessed holes 100*b* with fasteners 100*x* to the cabinet 94 resting on it. FIG. 4A also shows pan 100 in perspective with a drain hole 100*a* near the back/rear of the cabinet 94 to allow collected mosture to drip freely beyond the structure cabinet 94 is mounted to as shown in FIG. 17.

Several embodiments and ramification of the rotating member shown isolated in FIG. 2 will now be described. Using FIG. 5 as a bases to take from, as it shows the preferred embodiment of the inner and outer coil condenser tube/pipe compressors 66 and 68, I will proceed to discuss possible alternatives. FIG. 6 shows compressors 66 and 68 as conical and elliptical shape tubes. Elliptical at its point of conjunction with support 64, and smoothly transforming as they move away from center of rotation to a smaller cylinder shape tube, forming a conical configuration just prior joining the elbows 72*a* and 74*a*. FIG. 7 shows using a turbine compressor 70 with its impellers 69 instead of using compressors 66 and 68 multi-configurations. FIG. 10 and FIG. 11 illustrates two possible alternative of where the condensing tubes could be attached to the turbine compressor 70. FIG. 10 showing it at the extreme outer side edge wall, and FIG. 11 showing it attached to the top outer extreme edge above the side wall. FIG. 12 and 13 show both center compressor configurations 70 and 66,68 removed, allowing each tube performing the function of a compressor. FIGS. 10 through 13 illustrate variations in the heat exchanger configuration, showing in a cross sectional view the rotating member with vertical tubes rising from the base support 86, replacing coils 72,74 and 82,84. The vertical tubes are so arranged as to not allow their fins 39 to touch one another. FIGS. 10 and 11 show the fins 39 angled. FIG. 14 shows a turbine type fan blade at the top of the expansion chamber. FIGS. 10 through 13 show the fluid traps in the vertical position. FIG. 13 also shows the removal of the expansion compressors 82*c* and 84*c* with just a bend towards center of rotation forming a vertical fluid trap 83. FIGS. 12 and 13 show various places where the vertical tubes could be attached in the condensing chamber, from near the outer baffle 76 to near the center of rotation, thus forming a straight tube 97 lying horizontally and perpendicular to center of rotation radially to elbow down to base support 86 near where shaft 58 attaches. FIG. 13 shows various locations on the rotating member where the vapor or fluid control devices could be placed. As shown positioned under the inner tube/pipe 66 is a similar size tube teeing off just before the end of 66 and bent slightly in direction of center of rotation and attached to base support 86, forming by-pass 71. At this point, positioned at by-pass 71 is a possible vapor control device location 99. Also as shown coming down from elbow 74*a* is a tube teeing off and angling away from center of rotation, attaching to base support 86 forming tube by-pass 71*a*. At this point or location of by-pass 71*a* is another possible vapor control device location 103. Also as shown mounted on both tube/pipes 66 and 68 is another possible location 101 lying just beyond the tube support 64. Also as shown positioned at the orifice compressors 72*c* and 74*c* is another possible location 105 for a fluid control device. Also as shown positioned at the expansion compressors 82*c* and 84*c* is another possible location 107 for a vapor control device. Referring to FIG. 9 which shows an elevational perspective view of the rotating member with another embodiment of the coil configuration. As shown, tubes rising up from compressor 70, being attached as described in FIG. 11, are raised in about a $\frac{1}{3}$ helical turn counter to rotation just in side baffle 76. Eight tubes are implied rising forming the same configuration, but more or less could be arranged for. Each tube being finned, have a common center compressor 70, but each have their own orifice compressor, orifice, fluid trap, and expansion compressor assembly as already describe concerning the rotating member in FIG. 2. As the tubes reach the top of baffle 76, their relationship and configuration to the support baffle 76 is simlar to what has already been describe for coils 72 and 74 attachment. Proceeding downward from the attachment, tubes continue counter to rotation, forming about a ⅓ helical turn before reaching the fluid trap, whose design is similar to trap 82*b* and 84*b* already explained.

At this point I will begin to describe the secondary embodiment of said invention, which has its rotating member axis orientated horizontally. Referring to FIG. 21 which is a cross sectional axial view, and referring to FIG. 22 which is a perspective and cut away view: the outside casing shape is similar in appearance to that of a cement drain tile with its cylinder and horn lip configuration. The casing configuration of the secondary embodiment, like the primary one, is only a suggested approach which allows the secondary embodiment of said invention to operate. Surrounding and supporting the secondary embodiment's approximate cross sectional center is an environmental baffle support 154 with expansion wall baffles 164 to its right and left. Positioned about center in baffle 154 is a circular yoke collar support 148 with its collar ring edges protruding beyond both surfaces of the baffle 154. The circular lip collar ring supports four quartered cylinder walls 122*a* and 122*c* which are the top half quarters, and 122*b* and 122*d* the lower half quarters. All are secured with fasteners 148*x* to the yoke support 148. Where cylinder walls 122*a* and 122*b* attach to yoke support 148, at units left and right sides are openings 156 about ⅓ of yoke support circumference with louvers 158 inset in each side opening 156. Where cylinder walls 122*c* and 122*d* attach to yoke support 148, at units left and right sides are openings 160 about ⅓ of yoke support circumference with louvers 158 inset each side opening 160. Proceeding away from openings 156 is a baffle 138 encircling coils 72 and 74 forming a double walled doughnut configuration curving towards coils 72 and 74, then backing away smoothly to form the cylinder walls 122*a* and 122*b* in direction of the open end 120. The top and bottom cylinder walls 122*a* and 122*b* at their opposite end 120 from the yoke support 148 end, encloses, secures and supports an outer and inner double ringed configuration having louvers 128 latticed horizontally between them. The outer ring is secured to the cylinder walls 122*a* and 122*b*, and the inner ring 124, being about ⅓ the size of the outer ring is attached to the outer ring by four equally spaced radiating support arms 121. Now beginning with the top and bottom cylinder walls 122*c* and 122*d* at their opposite end from the yoke support 148, enlarge their diameter size in a horn like configuration to enclose, secure and support near its edge a circular wall 134, whose outer 1/8 of its diameter area is an open area 132 with protection rods 131 inset. As shown in FIG. 23 the outer edge of the circular wall 134 is attached to walls 122*c* and 122*d* with four equally spaced support arms 135 dividing opening 132 by extending inwards towards the circular front panel of 134, which has at its center a raised circular area 130.

Now beginning with the motor M, which is supported at its axial end to the said inner ring configuration circular mount 124 with fasteners 126, shaft 58*a* extends from motor M being immediately surrounded by a fan blade 62*a*, which extends to and stops just short of touching the inner cylinder walls 122*a* and 122*b*. Passing just beyond fan blade 62*a*, shaft 58*a* is welded to an end connector plate 79, whose complete assembly is illustrated in FIG. 20 including full description of the adjustable guide vanes 90 assembly described in the preferred embodiment. From plate 79 to the orifice compressors the tube configuration is relatively the same as describe in the preferred embodiment with the following exceptions. Because coils 72, 74 are set end to end with coils 82 and 84, the center tube/pipe support 64*b* must extend to the total combined height or length of each set before attaching to the disk cavity base support 86. Therefore, since the tube support 64*b* is surrounded by both sets of coils lying end to end, a disk shape baffle divider support 136 is needed, which replaces the cylindrically shape baffle 76 needed in the preferred embodiment. Surrounding the center tube/-pipe support 64*b* on both sides of baffle divider 136, are hour glass baffles 140 and 142. Baffle 140 sets snuggly between baffle 136 and compressor tubes 66 and 68, while baffle 142 sets snuggly between the other side of baffle 136 and disk cavity support 86. Baffle 136 outer edge is a tee fork 150 double edged configuration with openings 152 placed in the tee portion of fork 150. From orifice compressors to orifices 82*a* and 84*a*, two elbows are encountered instead of just one. From orifice compressors the tubes elbow 72*e*, 74*e* in the direction that parallels the axis of rotation as it approaches the baffle support 136 as straight tubes to be attached to it. Passing through and beyond support 136, the tubes elbow 72*g* and 74*g* counter to rotation with orifices 82*a* and 84*a* positioned at the ends of each elbow respectively. From here the tubes are helical only and not conical because the axis of rotation is horizontal and not vertical. If this unit where orientated vertically, coils 82 and 84 would be conical in configuration as described in the preferred embodiment. From coils 82 and 84 to and encluding the disk cavity support 86, their tube configuration is the same as described in the preferred embodiment. At the outer edge end circular wall of the disk cavity support 86, turbine type fan blades 80*a* fit snuggly around it, positioned radially to within the inner wall of the horn 162 configuration of cylinders 122*c* and 122*d*. At the outside of disk cavity support 86, at its center of rotation opposite support 64*b* is fastener device 64*x* without the impellers 64*a* to the support 86 and fastened to plate 79 as shown in FIG. 20 and describe in the preferred embodiment. From there the shaft 58*a* rising up from plate 79 is surrounded by bearing 146 affixed to and held in position by the back side of the front panel 134.

OPERATION OF THE CENTRIFUGAL HEAT EXCHANGER

I will be referring to FIGS. 1 through 20 in which I've shown the preferred embodiment of my centrifugal heat exchanger apparatus, and FIGS. 21 through 23 in which I have shown the secondary embodiment of said invention. Which embodiment of said invention is better, must be determined by the limitation or restrictions of the need. The materials used in each embodiment's contruction, are common to what is already used for such desciplines, which would enclude any other materials that may be found more suitable. Starting with FIG. 1, which is a cross section left view of said invention, I will now explain first of all the flow of refrigerant through the hermetrically sealed environment configuration, which is the primary reason for said inventions novelty and this patent application . In any rotating motion the center of rotation has hypothetically zero centrifugal force acting upon it. Moving incrementially outward from its center, forces increase in direct proportion to the rotating RPM's. This centrifugal force acting upon a fluid or gas/vapor, translates to compression in characteristic in said forces effecting nature. Translating this action more completely to ones understanding, I will begin with FIG. 1. At the center of rotation, where the center tube/pipe support 64 is attached to the inner and outer condenser compressors 66 and 68, the refrigerant vapor is being forced outward. The larger diameter of tubes 66 and 68 allow for more vapor to be compressed per revolution. This continuing action forces the vapor molecules closer together, which begins to heat up as it passes outwards through small openings 66*a* and 68*a* at the ends of tube/pipes 66 and 68. As this heated vapor passes through openings 66*a* and 68*a*, they enter a small tubular environment elbowing at 72*a* and 74*a* in direction of rotation. As the vapor begins to travel in the direction of rotation it is effectively moving faster around, thus encurring greater centrifugal force/compression upon itself, which encreases the heat of the vapor. Also, sense the vapor's travel configuration is conically helical, which brings it farther away from the center of rotation as it travels upward through the tubes, more compression is encurred, whereby vapor temperature is encreased. As temperatures become greater on the inside of the tubular environment than that which is on the outside, the mediating walls of the tubular configuration allow for heat to be given off. When the temperature rises higher inside the tube than the temperature that is outside the tube, condensation begins to take place, being enhanced under this pressure environment made possible by the restriction of the back side of orifices 82*a* and 84*a*. As condensation accumulates as liquid refrigerant it is slung outwards against the inner walls of the rotating tubes 72 and 74, which allows it to travel upward as it gives up more and more of its heat. As it reaching the top and end of coils 72 and 74, the refrigerant elbows at 72*b* and 74*b* turning away from center of rotation. Here the liquid refrigerant's position is in a some what straight tube lying perpendicular to axis of rotation being now forced against the back side of orifices 82*a* and 84*a*. The straight tubes 72*c* and 74*c* elbow at 72*d* and 74*d* counter to rotation just before orifices 82*a* and 84*a*. At this point the heat that had been picked up from the expansion tubes have been given up in the condensing tube environment, but yet being under pressure the fluid refrigerant is still vary warm when it passes through the small openings of orifices 82*a* and 84*a*, which provided the back pressure. After the liquid refrigerant passes through said orifices, it enters another conically helical coil configuration 82 and 84. Here the warm liquid refrigerant is immediately exposed to a low pressure environment, being on the back side of compressors 82*c* and 84*c*. Now the refrigerant is rotating more slowly as it moves down the the tubes counter to rotation. As the liquid refrigerant evaporates/boils off the walls in this expansion environment, it picks up heat from off the walls which were gather from air passing over the outside of the walls of the tubular environment. As the remaining refrigerant reaches the end of the coils 82 and 84, they encounter a fluid trap 82*b* and 84*b* which stops there traveling any farther down the tubes. The said trap configuration allows for only the heat laden vapor to pass, which is pulled into the back side of the compressor 82*c* and 84*c*. From there the vapor is forced outwards perpendicular from axis of rotation to elbow at 82*d* and 84*d* downward to the disk cavity base support 86, at openings 86*a* and 86*b*. As the vapor rushes down the coils 82 and 84, it also slows down in its rotation, thus reducing centrifugal force on it, which helps to encrease the rate of evaporation. When the heat laden vapors enters the disk cavity 86, they immediately are allowed to slwo down in their rotating motion, and are drawn unrestricted towards the center to fill the void compressors 66 and 68 have made. Being on the back side of compressors 66 and 68 the vapor is drawn up through an opening 86*c* placed at the center of the disk cavity top circular wall and into and through the center tube/pipe support 64. From here the refrigerant vapors pass over adjustable guide vanes 90 which are used to regulate the tonnage output by means of adjusting the flow rate of vapor flowing through the hermetrically sealed environment without slowing down the rate of rotation. The adjustable vanes 90 are angled in such a way as to scoop up the ascending vapor refrigerant as its normal orientation, but when needed can be encrementally closed to alter the flow rate as necessary. As the vapor refrigerant passes upwards beyond the adjustable guide vanes 90, they encounter deflector vanes 64*a* which keep the vapor refrigerant from stalling near center point. The deflector vanes 64*a* begins the outward movement of the heat laden vapor, which begins the cycle all over again by directing it into the back side of compressors 66 and 68.

The guide vanes 90 regulating the flow of vapor through the sealed environment, do so by being controlled by a electromagnetic control collar 92*a* and 92*b*. Using FIGS. 15, 16 and 20 the control assembly is made very clear, and is shown only as a suggested approach to communicate with the sealed environment. From the control panel 94*bc*, the preset command of the thermostat device 94*bt* shown in FIG. 19, is translated to magnetic energy by means of the control collar 92*a* and 92*b* electromagnetics 45 through their windings 47. Transistors 73 communicate a preprogramed electronic impulse to the outer circuit 75 circular board, which is soldered to the end windings 49, thereby allowing four equally spaced points around the inside of the control collar 92*a* and 92*b* to be magnetized at the same time. Thus all four vanes 90 are directed simultaneously by means of their sandwich plates 65 being in magnetic range. Communication between the control panel 94*bc* stationary member and the rotating member shown in FIG. 2 would be through collector rings and brush assembly not shown on shaft 58. The collar 92*a* and 92*b* are of a split configuration halved to allow for collars' assembly and removal once the center tube/pipe support 64 has been fabricated. As the guide vanes 90 follow the magnetic field change from one electromagnet 45 to an adjacent electromagnetic 45, the beveled gear 57 which is attached to the guide vanes 90 by means of the neck 61, rotate the guide vanes 90, thus changing their angle which effectively closes or opens as a gate to monitor the flow rate of the vapor refrigerant ascending the center support 64. The beveled gear 57 meshes with the beveled gear 59 located at the end of the stem support 90*a*, which revolve around the back side of studs 53 being screwed by means of a hex shoulder into the bearing 51 assembly, which is affixed by fastener 95 to the underside or end recessed area of the stem support 90*a*. Thus allowing for a stablized and controlled rotating movement either backwards or forwards around center of rotation. The stem support 90*a* at its other end opposite of beveled gear 59, has a threaded hole 93 centered, which allows stem support 90*a* to be drawn up tight against the underside of the fastener device 64*x* and centered with fastener 87 whose flat head configuration fits into the tapered hole 91, which brings it flush with the top surface of the fastener device 64*x*. Protruding through and rising above the fastener 64*x* circular plate configuration are four studs 85 equally space around near its outer edge, having their head configuration lying on the back side of the fastener plate 64*x* as winged or vane/impellers 64*a*. These vanes 64*a* as the heads of studs 85, are wedged in grouves which hold it in place keeping it from turning when studs 85 of fastener 64*x* pass through openings 89 in the end plate 79 to be drawn tightly together by fasteners 77 of studs 85. At this point all rotating energy is passed to the rotating member by weld 81 at the end of shaft 58, which is attached to the center of the end plate 79.

Now I will begin tracking the air movement through said invention's various baffle configurations beginning at the cover shield 50, also shown in FIG. 4H. Here air is suck into the unit from an heat sink environment, through the screened portion 50*a* of shield 50. In coming air passing through screen 50*a* also passes between the supporting members 50*d* and up over the base lip 50*e*, which help to keep out rain water than may pass through the screen 50*a*. As the air moves up over the base lip 50*e*, it also passes over the raised lip 50*c* surrounding the opening 50*b* shown in FIG. 4E, before the air begins to descend into the intake support horn baffle 52*a*. Fasteners 50*x* help to stablize the cover shield 50 from being blown off top cover and support frame 52, thus keeping the motor M, lying just below, from water damage. The base 50*b* provides fasteners 50*x* a place to attach cover shield to the top cover 52, which is attached to the cabinet/casing 94 top edge of their walls with fasteners 94*x* passing through the inset area 52*e* holes 52*f*, which allows the cover lip 52*d* to rest on the top edge of the four walls of the cabinet/casing 94. The intake opening 52*b* is the beginning of the support horn 52*a* which surrounds and supports the motor M. As the descending air travels downward, its path narrows within the horn configuration and passes the fan blades 62 which have been pulling it. Upon passing the fan blades 62, the air is pushed passed and around the motor M descending through the upper support motor mount 56, whose deflective vanes being to swirl the air in the direction of rotation. As the air continues down it encounters another support motor mount 54, whose deflective vanes being angled even greater, places an even greater swirling motion to the descending air. As the descending air passes beyond the lower motor mount 54, having cooled the motor M as it passed it, it encounters the condensing chamber area with less turblence because of its already swirling or rotating motion when it is slung outward upon encountering the spinning compressor tube/pipe 66 and 68. As the air encreases its rotation it is channeled outward and upward by means of the insulated baffle 78 whose curved bowl shaped bottom 78*b* allows the air to smoothly change its direction back upward between the outer wall of baffle support 52*a* and the inner wall of baffle 78. As the air direction changes it encounters the conically helical coils 72 and 74, picking up heat from off their walls. The heat laden air now is pulled up through the coil configuration by means of the turbine type fan blade 80, which encircles the air path directly above the condensing chamber. As the heat laden air pass the fan 80 it enters above the horn ring baffle cover 98 swirling around the out side of the intake support horn baffle 52*a*, and up against the under side of the top cover 52 to be ducked out through openings 94*aa* at the backside 94*a* of unit 94. Here the heat laden air passes between louvers 94*ab* and under the hood shield 94*ac* all of which are design to keep the elements out, while the heated air is distribute into the heat sink environment.

While this is going on as mentioned above, air is also brought into the unit from an environment needing conditioning at the front 94*b* left 94*bl* and right 94*br* openings. Here the air is pulled into the unit 94 double walled stationary baffle 96 through the front 94*b* wall less side of the three walled-rectangle baffle 96*c*. Incoming air then circulates around between baffle 96*c* and the cylindrical inner baffle 96*a* and above the flat mediating surface 96*b* which unites the two baffles together at their bottom edges. The air lying between the doubled walled baffle 96, is pulled up over the edge of the inner baffle 96*a* towards the center of rotation with the horn baffle core 98 underside providing a curved surface to turn the air back down. As the air from the warm environment to be conditioned reaches the espansion coils 82 and 84 cold tubes, condensation begins taking place as the heat and moisture laden air passes down ward circulating around coils 82 and 84 lying between the stationary baffle 96*a* and the rotating baffle support 76. The rotating coils 82 and 84 sling to the outside, the mositure collected through condensation against the wall of the baffle 96*a*. From there the mositure runs down baffle 96*a* and drops into the trap/pan base 100 which is attached to the underside of the unit 94, being secured with fasteners 100*x* through counter sunk holes 100*b*. The collected mositure in the pan/base 100 is allowed to puddle to a point where it pours out of a opening 100*a* in the floor of the pan/base 100 toward the back 94*a* of unit 94. Continuing now with the air passage through the expansion chamber, as the air passes beyond the coils 82 and 84, they are pulled pass the squirrel cage fan 88*a* and 88*b* which have been doing the pulling. From here the air is thrown outward and channeled downward under the rotating disk cavity base support 86 from the back and left and right sides, and over the pan/base 100. From here the air passes out the front 94*b* of unit 94 at the twin exhaust openings 94*ba* near the bottom, through the inset louvers 94*bb*. Moisture being slung out from between the fan blades 88*a* and 88*b* at the front of unit 94 is collected in a gutter 94*bd* which lies between the control panel 94*bc* and above the twin exhaust openings 94*ba*. This arrangement keeps the moisture from spraying out into the conditioned environment by passing the moisture collected in the gutter 94*bd* down the center drain channel 94*be* to the floor of the pan/tray base 100.

The outer cabinet or casing 94 is shown only for the benefit of conceptualizing a way of utilizing the principles of physics set in motion by the rotating member, and is not to be construed as constraints to this patent application. The physical design configuration of this primary embodiment of the stationary member casing 94 has not only taken into consideration the air flow requirements but also those that which make for easy maintenance. As shown, the bottom pan/tray base 100 is attached to the cabinet/casing 94 with fasteners 100*x*. This arrangement allows the base 100 to be removed for cleaning and maintenance of the rotating member and/or replacement of the motor M. The following procedure may be followed for such maintenance. First the unit must be unplugged form its electrical needs. Then beginning with the removal of the base pan 100 by unfastening fasteners 100*x* which are counter sunk in holes 100*b*, the following problems can be remedied.

The cleaning of the base pan 100 and the unplugging of the drain hole 100*a*, and also the recharging of the refrigerant level by means of the recharging device 102 under lying the disk cavity 86 at its center. If further maintenance is required which would necessitate the need for the removal of the rotating member, the following procedure should be followed. The first step necessary at this point is to remove the screen cover intake shield 50 by unfastening fasteners 50*x*. Once unfastened, the cover shield 50 can be lifted up away from from the top cover and support frame 52. This procedure exposes the fan 62 which now can be cleaned, then if necessary fastener 62*x* which secures the fan 62 to the shaft 58, can be unfastened allowing the shaft 58 to slide down through the bearing 60 and motor M. At this point the bearing 60 can be replaced if necessary. As the shaft 58 slides downward through the motor M, the rotating member being attached to the shaft 58, drops down pass the bottom edge of the cabinet/casing 94 and must be carefully placed on pillow mounts so that the recharging device is not damaged. When rotating member is in this position, such maintenance as cleaning of the coils 72,74 and 82, 84 can be performed. Also at this time the cleaning of the fan blades 88*a* and 88*b* and also fan blades 80 can be performed, all of which maintains the units efficiency. Also the collector rings and brush assembly which are not shown, and would be normally placed on the motor M and shaft 58, could be replaced if needed or corrected along with any electrical problems that might have occurred in or with the control collar 92*a* and 92*b*. Now that the rotating member is free from the motor M, the top cover and frame support 52 can be removed for the maintenance or replacement of motor M. To accomplish this fasteners 94*x* located at the upper edge left, right and front of unit 94 must be removed, which allow top cover and frame support 52 to be lifted up and away from the cabinet/casing 94. With the top cover and frame support 52 removed, the motor M can now be removed and replaced if necessary by first unfastening fasteners 65*x* and 54*x* which holds the motor M within the inner collars of 56 and 54 deflective vane support motor mounts. Once the motor M has been removed, the motor mounts 56 and 54 can be removed for cleaning by unfastening fasteners 52*ax* located on the outer wall surface of the horn baffle support 52*a*, which secure the outer collar of motor mounts 65 and 54 resting on shoulders 52*aa* and 52*ab* respectively. This allow them to be pulled up through the intake opening of the support horn baffle 52*a*. If further cleaning or replacement is needed to the remaining stationary baffles, fasteners 98*x* holding the horn ring baffle cover 98 to the double walled stationary baffle 96 can be unfastened, allowing removal of cover 98. If baffle 96 needs removing, fasteners 96*x* must be unfastened, located on the mediating surface 96*b* which fastens baffle 96 to the protruding ledge 94*pl* inside the cabinet/casing 94.

Several embodiments of the operation and ramifications thereof of said rotating member shown insolated in FIG. 2 will now be describe. Using FIG. 5 as a bases to talk from, as it shows the preferred embodiment of the inner and outer coil condenser tube/pipe compressor 66 and 68 operation, I'll proceed to discuss possible alternatives of said operation. FIG. 6 configuration of compressor 66 and 68, provides the vapor refrigerant to pass more smoothly into the coils 72 and 74 which may prove to be an advantage along with its fabracation. FIG. 7 shows using a turbine compressor 70 with its impellers 69, this may prove more effective when greater flow of vapor is demanded per revolution. FIG. 10 and 11 show two possible alternatives in the operation of the refrigerant path exiting compressor 70. One path exits at the outer end/edge, while the other path exits at the top outer edge. Also as shown in FIGS. 7, 10 and 11 are samples of the various configurations compressor 70 could come in. FIGS. 10, 11, 12 and 13 show the condensing and expansion operation divided between individual tubes verticaly arrayed, being finned to enhance heat exchange, with any combination of their parts to be used as required. FIGS. 10 and 11 show the operation without the need of additional fan/impellers by utilizing fins 39 that are angled. Fig.12 shows the operation of the condenser compressor 97 removed, and FIG. 13 shows the expansion compressor removed, leaving the fluid trap 83 inplace, while the operation of the fan 88*a* and 88*b* is replaced with a turbine type fan like 80 affixed to the top outer cylinder wall of baffle 76. The advantage of the design configuration shown in FIGS. 10, 11, 12 and 13 may be that it may prove easier to fabricate a straight finned tube than a helical coil finned tube, with another advantage being that it may prove more stable structurally at higher RPMs and/or under certain conditions. FIG. 9 shows the operation of the condensing and expansion tubes used also as a means with or without being finned to move air through the rotating member, by having about a ⅓ helical turn configuration so orientated that its angle of helical turn raises the air up in the condensing chamber, and brings the air down in the expansion chamber. FIG. 14 shows various means and places where the operation of controlling the rate of refrigerant flow could be located but not limited to. As shown under the inner tube/pipe compressor 66 is a by-pass tube 71 with its control device 99, which allows when opened, to prevent most of the vapor refrigerant to ascend the inner helical condensing coil 72, and being placed under compressor 68 would control the flow rate up the outer helical condensing coil 74. As shown positioned beyond compressor 68 and under coil 74 is a by-pass tube 71*a* with control device 103 positioned to regulate vapor refrigerant flowing up condenser tubes 74, with said application applying also to condenser tubes 72's compressor 66. As shown place on both compressors 66 and 68 is another vapor control device location 101 with its regulating qualities. As shown located at the orifice compressor 72*c*, which would include the orifice compressor 74*c*, is a fluid control device location 105 where such control might be possible. As shown where the expansion compressor 82*c* and 84*c* are located is another location 107 where a vapor control device could be located.

Referring to FIGS. 21, 22 and 23, I will now begin to describe the operation of the secondary embodiment of said invention, which has its rotating member axis orientated horizontally. Beginning with the operation of the cylinder casing and its supporting elements, the expansion wall baffle 164 leads off first in this discourse. The primary function of baffle 164 is to provide a flexible means to enclose a window opening whose width is wider than the environmental baffle and support 154. And this is by no means the only way to do it. It is purely a suggested approach in its design configuration which allows in this case baffle 164 to slid outward to the remaining width of the window once the unit is in place. The support 154 surrounds the casing which is comprised of four halves, if we speak of it as to areas which lie on both sides of the support 154, but if we speak of it as a whole, the casing is composed of four quarters. This configurated arrangement allows for easy assemble and maintenance. Each quarter has either a top or bottom half relationship to the whole and will be referred to as such. The casing configuration could be of a stamped out process so fabricated and designed to provide for baffles 134 and 144, with provision for intake openings 156 and 160 with louvers 158 inset each, which lay against both sides of the baffle 154 when in place. On one side of the baffle 154 is the condensing chamber surrounded by the top casing half of the condensing cylinder wall 122*a* and the bottom half 122*b*. On the other side of the baffle 154 is the expansion chamber surrounded by the top casing half of the expansion cylinder wall 122*c* and the bottom half 122*d*. Both cylinder chamber walls are attached to the circular yoke collar support 148 protruding from baffle 154. The supporting yoke 148 configuration allows for fasteners 148*x* to be placed in its lipped area securing the four quarter casing walls into a cylindrical configuration, which becomes the supporting element for the rotating member. The rotating member configuration places the condensing chamber and the expansion chamber end to end with a circular baffle divider 136 lying inbetween, which also acts as a supporting element to coils 72, 74 and 82, 84 by having their mating ends supported by baffle 136. The power for the operation of the rotating member, lies in the condensing chamber environment. Its power source is a motor M attached to the circular mounting 124 at the exhaust end of the condenser chamber 120. The weight of the motor M is transfered from the circular mounting 124 to the cylinder walls by four radial supporting arms 121 to an attached encircling outer ring, which is attached by fasteners to the inside edge of the top 122*a* and bottom 122*b* condensing cylinder walls. To keep rain and other elements out of the condensing chamber area, horizontal louvers 128 are used mediating across opening 120, being attached to the outer encircling ring and the inner circular mounting 124. With the heat exchanger tubes 72, 74 and 82, 84 positioned end to end the center tube/pipe support 64*b* must now extend the entire distance of the combined length of helical travel around support 64*b* before attaching to the disk cavity support 86. Because of the rotating member's length and horizontal position, the fastener assembly 64*x* is secured to the back side of the disk cavity support 86 at its center, opposite the facing side of the disk cavity support 86, attached to the center tube/pipe support 64*b*. From here the weight is transfered to a bearing 146 by means of a short circular member rising up from the fastener assembly 64*x*. Baffle 136 is attached to the center tube/pipe support 64*b*, which is the extended version of 64. At the outer edge of baffle 136 a tee configuration comes off it which allows the baffle 136 to fork 150 into two short walls which surrounds a short protruding wall extending from the lipped circular yoke 148. To keep foreign elements from the condensing chamber from entering into the expansion chamber at the point where the stationary yoke 148 descending short wall is surrounded by the rotating baffle 136 forked walls, slot openings 152 are appropriately placed within the tee configuration which keeps air passing on both sides of the protruding wall of yoke 148, thus blowing away any foreign elements.

The path of refrigerant flowing through the coils is basically the same as described in the preferred embodiment shown in FIG. 1 with these exceptions. When fluid refrigerant leaving coils 72 and 74, they encounter three elbows instead of just two. Starting at the end of the orifice compressors 72*c* and 74*c*, elbows 72*e* and 74*e* bend away from motor M forming a straight tube section 72*f* and 74*f* which parallel with the axis of rotation, which proceed through and is attached to the baffle 136. Proceeding pass the baffle 136 the liquid refrigerant is forced against the back side of orifices 82*a* and 84*a* after bending at elbows 72*g* and 74*g* counter to rotation. From said orifices the helical path of the refrigerant is simular as described in the preferred embodiment minus the conical configuration. If the axis of rotation where vertical, the coils 82 and 84 would be identical to the preferred embodiment.

Now as to the air flowing through the unit, the changes are major. Beginning with the condensing coil environment, air is drawn in near the support environment baffle 154 at openings 156 through inset louvers 158 which keep out foreign elements from the heat sink environment. As incoming air circulates around coils 72 and 74, for reasons describe in the preferred embodiment, its incoming movement is channeled around the doughnut shape baffle 138 which forms part of the casing wall, and its outward movement from the condensing chamber is controlled by means of the hour glass baffle 140. As the heat laden air leaves the condensing chamber it passes through the fan blades 62*a* which has been pulling it through. From the fan blades 62*a* the air is now pushed around and through the motor M cooling it also before passing through the end opening 120 between louvers 128 to be dumped into the heat sink environment. Beginning with the expansion coil chamber environment, the air movement changes are also major. The air is also drawn in near the environment baffle 154 at openings 160, which is adjacent to opening 156 but on the other side of baffle 154. As air moves into the expansion chamber environment, it also passes through louvers 158 which keep out elements from the condition environment. As the air circulates around coils 82 and 84, for reasons described in the preferred embodiment, its incoming movement is channeled around the doughnut shape baffle 144 which forms part of the casing horn 162, and its outward movement from the expansion chamber is controlled by means of the hour glass baffle 142. As the cooled air leaves the expansion chamber environment, it passes outward between the horn 162 configuration casing wall and the outer circumference of the disk cavity support 86 through the radial fan blades 80*a* attached to the end outer circumference of the disk cavity support 86. From here the air is pushed out the front facing panel 134 opened area 132 through protective rods 131 back into the environment being conditioned. Behind the front facing panel 134 at its center is mounted the bearing 146 which supports the rotating member's other end opposite that supported by the motor M. The rotating member's weight is transmitted to the outer walls by means of the four supporting arms 135. The control panel 130 is positioned at the center of the front panel 134, which controls the on/off power, temperature and speed of rotation.

CONCLUSION, RAMIFICATIONS AND SCOPE OF INVENTION

Thus The reader will see that the centrifugal heat exchanger invention provides a highly reliable, light weight, yet very economical device which when properly cared for will allow its user an easily maintained unit at minimum cost. While the above discription contains many specificities, these should not be construed as limitations on the scope of the invention, but rather as an exemplification of two embodiments thereof. Many other variations are possible. For example, in the preferred embodiment the power source could be placed at the underside of the disk cavity base support 86 where the recharging device 102 is located, and the recharging device 102 located at where the motor M is now located. This would allow for a smaller diameter unit. Another possible variation would be a piggy back motor combination working off the same shaft 58 extending up into the horn support baffle 52*a*. Another possible variation would be the elimination of deflector vanes in the motor mount supports 56 and 54, replacing them with just one or more radiating arm supporting the motor M. Another possible variation would be to extend the shaft 58 between motor M and fastener 64*x* assembly so that motor M is positioned above the rotating member. This would allow the rotating member to be made with a correspondently smaller diameter. Another variation would be to extend the shaft 58 up beyond the cover shield 50 with a pulley or sprocket configuration attached to its end so that an alternate power source could be used. Another possible alternative could be in the casing 94 configuration by having openings for the intake or exhausting of air, utilizing the left and/or right sides of unit 94 if the physical restraints or mood require it. Another variation could be the replacement of the material composition of the orifice compressors 72*c* and 74*c*, with heat dampening or restraining material to keep the warm condensing tubes heat from interfering with the cooler expansion tubes. Another possible variation could be to hinge the louvers which allow them to close when unit is not in use, and to open when unit is in operation. Another possible variation would be to control units tonnage output without changing RPM, by mechanically controlling the louvers opening and closings, thereby restraining the effective output. Another possible variation would be to fin the coil tubes 72, 74 and 82, 84 which would allow for less tube length per helical coil. Another possible variation, when fins are applied to coil tubes 72, 74 and 82, 84, would be to have their fins bent or angled in such a way as to be used to force air in one direction or the other, causing air movement to raise up in the condensing chamber and to lower moving downward in the expansion chamber. This may make it possible to eliminate the need for having fan blades.

In the secondary embodiment, another variation would be to remove the motor M and replace it with a pulley or sprocket device, thus shortening the units length and allowing other sources for driving power. Another possible variation would be in using any one of the various locations as shown in FIG. 14 that would be compatible to its design configuration, for a refrigerant control device. Another possible variation would be to have a gear assembly mediating between the motor M and the rotating member to encrease or decrease the rotating member's RPM. Another possible variation would be its coil configuration as shown in FIGS. 9, 10, 11, 12 and 13 for the preferred embodiment. Another possible variation would be to use friction free magnetic bearings as described in the Popular Science, March 1987 issue on pages 70 and 71. Another possible variation would be to use such materials comprising of photonic materials, advanced metals, advanced ceramics, advanced polymers and composites wherever found expedient. Explained in Scientific American, October 1986 issue. Another possible variation would be to use fiber optics in palce of copper and aluminum wherever possible. Another variation would be to use micro waves to do the work of the collector rings and brush assembly. Another variation would be to have three or more sest of helical and/or conical coils in both embodiments. Another variation would be to have a multiple speed motor controlling the air and temperature demands. Accordingly, the scope of the invention should be determined not by the embodiments illustrated, but by the appended claims and their legal equivalents.

I claim:

1. A centrifugal heat exchanger for temperature control and heat transfer comprising:

a cylindrically shaped multi elemented rotating member, enveloped by a stationary support member, means for attachment of power source driving said rotating member mediating between said support member and said rotating member, and means for said rotating member to simultaneously produce two artifical currents of controlled air with environmental integrity, by means of a baffle member and blade impeller members as integral parts of said rotating member, and means for utilizing centrifugal force embodied within said rotating member for compression and circulation of refrigerant within a hermetrically sealed fistulous and fabricated environment, and means for maintaining a preset temperature with a fixed RPM of said rotating member, by means of a control device/s modifying or restricting the flow of refrigerant, and means for said stationary support member to channel said artifical currents of controlled air with said environmental integrity, to and from said rotating member, by means of stationary baffles, and means for recharging hermetrically sealed environment with refrigerant, and means for the refrigerant condensing environment to be closer to axis of rotation than that of the refrigerant expansion environment.

2. The centrifugal heat exchanger of claim 1 wherein said means comprising said rotating member's power source is a motor with a vertical orientation of its driver shaft proceeding downward in direct drive relationship, is attached at center of rotation of said rotating member, which hangs below said motor surrounding it in a bowl like configuration, with said attachment assembly comprising an end shaft member and fastener device assembly member, which secures rotating energy to said rotating member's center of axis axially, wherein said shaft member passes upward through and above said motor member, with raised portion of said extended shaft member above said motor member surrounded by a load bearing member, whereby above and adjacent to it is secured a fan blade impeller member for vertical downward load bearing pressure and rotating movement against said motor member, thereby keeping the vertical distance between said rotating member and said stationary support baffle members at a fixed distance, while at the same time providing a means of artifical currents of controlled air to be pushed into the condensing chamber for the purpose of removal and transportation of heat into the heat sink environment.

3. The centrifugal heat exchanger of claim 2 wherein attachment at center comprises a centrical compressor member/s radiating perpendicular to axis of rotation, facilitating vapor path outward from center of rotation by centrifugal force, whereby compression is established and maintained against backside of the expansion device.

4. The centrifugal heat exchanger of claim 3 wherein a centrical tubular support member mediating between and at their axial centers of said centrical compressor member and a thin hollowed disk shape cavity, which facilitates vapor returning to center of rotation, and structural stability as a base support member, whose outer edges comprises more or less the outer limits of the rotating member, which has opening means to receive vapor from the expansion environment and structural support for said expansion environment's structural configuration which are placed opposite of one another at the top mediating surface with center of rotation in between, including also a opening at center of said top mediating surface, which facilitates vapor entering into the said tubular support member with means of attachment, while the opposing wall of said mediating surface of said cavity base support member, has at its center of rotation a opening means for a recharging device member being attached to said center and above said opening for the placement or replacement of refrigerant in the said hermetrically sealed environment.

5. The centrifugal heat exchanger of claim 4 wherein said top mediating surface of said disk cavity base support has secured to it an open end cylindrical baffle member rising up from said mediating surface, whose said secured edge sets back a short distance from the said outer edge or circumference of said top mediating surface, thus providing environmental air integrity between the condensing environment which is located inside said cylindrical baffle and the expansion environment lying out side the said cylindrical baffle wall, with the top edge of said baffle wall supporting and enclosing and flushed along its said top edge is a air movement means which pulls air out of the condensing chamber, whose inner circumference encircle the outer wall of the said motor support horn assembly member, and also just below the said air movement means outer circumference being attached to the inner wall of the said baffle support are opening means placed directly across from one another, which facilitate passage and securing of tube perpendiculalr to axis of rotation whose function is that of a compressor, while at the same time providing support to both the condensing tubular environment and the expansion tubular environment.

6. The centrifugal heat exchanger of claim 5 whose said cylindrical baffle secures and surrounds a thin walled insulating baffle having an inside bowl like configuration which sets down below said air movement means which secures said insulation baffle in place, whose out side configuration conforms to facing surfaces of both said mediating too surface of said disk cavity base support and the inner walls of the said cylindrical baffle, thus said bowl like configuration provides not only smooth air flow change of direction but also having opening means at is center bottom surrounding said center support, where also two opening means are positioned opposite each other located at and just under the said air movement means near the top edge of said insulated baffle whose placement matches that of the said opening means in the top edge wall of said cylindrical baffle support, where upon temperature interference between condensing and expansion chambers are kept from occuring.

7. The centrifugal heat exchanger of claim 3 whose said centrical compressor member having opening means at the outer end of the said centrical compressor which facilitates vapor to enter into the condensing tubular environment at the same time securing said condensing tubular configuration/s proceeding from it, which elbows forming a conically helical configuration in direction of rotation ascending with each turn being incrementally farther from center of axis than the preceeding one with allowances made for one or more of such configuration to stand alone or to be set one inside the other in close proximity, having one set of said conically helical configuration with a smaller radius than the other, whereby the end/s of said conically helical configuration/s elbow/s bending away from center of rotation to form a straight section which passes through said insulation baffle and the cylindrical support baffle supporting it, thus forming a fluid reservoir under centrifugal compression against the back side of the expansion device, as tubes can be finned or not, the said straight section could be of a non-heat transferable material.

8. The centrifugal heat exchanger of claim 7 whose said straight section lies perpendicular to the rotating axis comprising in this case of two, but one or more than two could be arranged for, pass beyond the said cylindrical baffle support to elbow bending back counter to rotation with one or more conically helical sets of such configurations forming the expansion tubular environment with every helical turn being incrementally closer to the center of axis than the last one until a fluid trap is encounter at the end of the expansion tubular environment which allows only for vapor to pass, from which proceeds a short tubing lying perpendicular to center of axis which forms a compression effecting member which pulls vapor out of the expansion tubular environment, where upon vapor enters at the outer opening means of the said top mediating surface where said tubular attachment is located being the outer extremities of said surface whereby vapor is allowed to enter the said disk cavity for its return towards the center of rotation, as also in this case said tubular configuration/s can be finned or not.

9. The centrifugal heat exchanger of claim 3 wherein said center support is surrounded near said disk cavity support base by a narrow collar comprising two half circle ring configuration with fastener assembly uniting halves together, where upon said collar encases on three sides electromagnetic members against the outer surface of the said center support member, with electronic circuitry cirumferencing said collar's surface, whereby control is conducted from transitors to said electromagnetic members making contact with end wrappings penetrating collars outer surface, thus through preprogram means four said electromagnetic members being equally space apart are energized at the same time with means for adjacient elecromagnetic members to also be energized when needed.

10. The centrifugal heat exchanger of claim 2 wherein suggested said fastener device member plate has a recessed hole at its center, whereby said fastener device is allowed to pass through to secure a rod assembly member against the under side of said plate fastener device member, which said rod's other end being geared at its outer edge, is secured to a bearing member by means of a fastener which passes through said bearing member which is compound in configuration, having four threaded opening means around its outer circumference equally spaced around the said compound rotating bearing member, whereby four threaded stud gear and vane members are fastened, with said vanes composed of a non ferrous substance and having at their outer edge circumferencing end a metallic and/or magnetic member with fastener means, thus allowing for the said collar with its electromagnetic members to pull on ends of said vanes in a rotating motion which forces the said vanes to turn on the gearing member which meshes with said end gear configuration of said rod, thereby changing the angle of vane which causes vapor travel to be modified as it passes through said center support manifold.

11. The centrifugal heat exchanger of claim 1 wherein said means comprising stationary member forming a six sided enclosure with openings at one side, whose facing top area adjacent edge comprise two rectangle shape openings with inset means for foreign element restraints with sheilding means, whereby heat is exhausted out into the heat sink environment having been collected from the off the condensing refrigerant environment wall configuration, where upon the facing wall comprising four protruding rectangle shape openings, with two positioned in adjacent horizontal positions near its bottom lower edge, having inset means to restraing foreign elements from entering and also providing deflectional control of conditioned air passing out through said adjacent openings, whereby immediately above said adjacent protruding openings comprise a narrow control panel whose top enclosure forms a ledge with rectangle openings set vertically to its left and right extremities, whose lower edge comprises said ledge, and its top protruding edge is positioned from the top edge about ⅔ the width of said left and right openings, with said side outer extremities of left and right openings protruding configuration forming part of the flat continuous mediating surfaces of stated said opposing side surfaces, having near their top edges of said latter opposite facing side and said left and right mediating sides fastener openings for the securing of the top side, and fastener openings along the bottom end edges of said latter and former opposing side surfaces, and left and right mediating side surfaces for the securing of the bottom side surface.

12. The centrifugal heat exchanger of claim 11 wherein said top side surface having at its center a opening means for air intake to be channeled through the condensing chamber environment, whereby a cylindrially shaped cover sheild configurated with a screened area circumferencing about ¾ of its total said circumferencing area, being divided by four supporting members which rises up from the base support, thus stabilizing the screen and top cover section of said cover sheild which is secured to the said top side surface.

13. The centrifugal heat exchanger of claim 12 whereby said intake opening is circular and liped, raising up from the said top side surface to keep water from entering, said lip continues down in a circular horn configuration narrowing to where it encircles and supports said motor with two radial vane support mounts at either end of said motor having a vertical axis, with said mounts resting on protruding shoulders in side encircling said support horn, whereby supporting said motor and channeling intake air in a controlled motion allowing it to pass over motor and condensing hermetrically sealed environment for their cooling.

14. The centrifugal heat exchanger of claim 11 having at said bottom edge a mating surface configurated means for attachment of bottom side surface near its edges, having means for the removal of moisture through small opening in flat surface of said bottom side surface at center and near former said side.

15. A centrifugal heat exchanger for temperature control and heat transfer of a secondary embodiment comprising a cylindrically shaped multi elemented rotating member orientated horizontally, and vertically with certain modification in the expansion refrigerant environment configuration, being envelope by a stationary baffled support member, having power source attachment, mediating between said stationary support and said rotating member at one end and a load bearing means at the other end of the rotating member, having two artifical currents of controlled air produced simultaneously with environmental integrity by means of a baffle member, positioned about center of rotating member, which separates the heat exchanger chambers lying end to end, whereas blade impeller members are integral parts of said rotating member, whose design configuration also allows for the utilization of centrifugal force embodied within said rotating member for compression of refrigerant and its circulation and regulation within a hermetrically sealed fistulous and fabricated environment, where in stationary support member channels said artifical currents of controlled air with said environmental integrity, to and from said rotating member, with said members structural composition utilizing elements commonly in use or any new elements or combination thereof.

16. The centrifugal heat exchanger of claim 15 wherein said rotating member power source is a motor secured to said stationary support end wall by said motors axial end opposite shaft end with horizontal orientation of said shaft, which proceeds from it in direct drive relationship to said rotating member, being attached at center of rotation, whereby a fan blade member to push air through the condensing environment, encircles said shaft between said motor and securing means assembly comprising an end plate secured to end of said shaft, whereby said end plate having four openings equally spaced near outer edge of said end plate for fastener device assembly comprising four studs equally spaced around and rising up from flat circular too surface of said fastener device assembly member, having the heads of said studs vane shape of a thin walled rectangle configuration lying below said flat surface bottom side in the hermetrically sealed environment as a means to keep vapor from stalling at center of rotation, whereby said studs matches and aligns to said openings in said end plate being fastened by four matching stud nuts, which secures rotating energy to the fistulous center support axial end, where upon said fastener device member plate has a recessed hole at its center, whereby said fastener device is allowed to pass through to secure a rod assembly member against the under side of said plate fastener device member, which said rod's other end being geared at its outer edge, is secured to a bearing member by means of a fastener which passes through said bearing member which is compound in configuration, having four threaded opening means around its outer circumference equally spaced around the said compound rotating bearing member, whereby four threaded stud gear and vane members are fastened, with said vanes composed of a non ferrous substance and having at their outer edge circumference end a mettalic and/or magnetic member with fastener means, thus allowing for the said collar with its electromagnetic members to pull on ends of said vanes in a rotating motion which forces the said vanes to turn on the gearing member which meshes with said end gear configuration of said rod, thereby changing the angle of vanes which causes vapor travel to be modified as it passes through said center support fistulous configuration.

17. The centrifugal heat exchanger of claim 16 whose said fistulous center support axial end comprise a centrical compressor member having opening means at the outer end of the said centrical compressor member which facilitates vapor to enter into the condensing tubular environment at the same time securing said condensing tubular configuration/s proceeding from it, which elbows forming a conically helical configuration in direction of rotation ascending with each turn being incrementally farther from center of axis than the preceeding one with allowances made for one or more of such configuration to stand alone or to be set one inside the other in close proximity, that is having one set of said conically helical configuration with a smaller radius than the other, whereby the end/s of said conically helical configuration/s elbow/s bending away from center of rotation to form a straight section which forms a fluid reservoir under centrifugal compression against the back side of the expansion device, after which said straight section bends away from motor parallel to axis of rotation and passes through said opening near said center thin walled baffle circular outer edge being also secured to it as said coil supporting member, whereby said supporting tube member which passes through said baffle could be of a non-heat transferable material.

18. The centrifugal heat exchanger of claim 17 whereby proceeding pass centrical compressor the said fistulous center support continues a long fistulous configuration and about halffl way of its length is a thin circular walled baffle member which isolates the two exchanger chambers, wherein outer circumference has means for sealing both environments from one another, that is between the outer casing and said rotating member baffle, and lying between said centrical compressor and said circular baffle member is a hour glass baffle configuration member for air channeling or directing, likewise a simular hour glass like configuration lies adjacent against the backside of said circular baffle member surrounding said fistulous center support member, and extending to the face side of the disk cavity base support configuration which has at its outer circumference a set of radiating impeller vanes for the purpose of pulling air through the expansion chamber, which also establishes more or less the outer limits of rotation, whereby said disk cavity facing circular flat surface have two opening means near or at outer circumference opposite of one another, which also secures end of expansion tubes, thus facilitating the need for vapor returning to center of rotation counter to centrifugal force, where upon said disk cavity back side has at its center of rotation means for fastening to a short shaft which extends to a bearing configuration which secures the rotating motion to the stationary support end wall.

19. The centrifugal heat exchanger of claim 17 wherein said tube support passing through said circular baffle a short distance, bends elbowing counter to rotation at which pont expansion device is located, at which point tubular configuration proceeds rotating around axis of rotation at the same radial distance per turn, moving away from said circular baffle in a multi revolution configuration forming one or more helical coil member/s, wherein if two or more are used, one would be set adjacent to the other/s having a smaller radius in relative distance to center of rotation, that is one set in side the other, this would enclude any fistulous configuration with expansion purpose in mind, thus with said configuration/s reaching near the said facing circular flat surface base support of the disk cavity, the tube/s form a fluid trap where only vapor it allowed to pass beyond the impediment, there are tube/s position is perpendicularly a straight section tube/s radially from center of rotation, which allows for the pulling of vapor from the expansion environment, thus acting like a expansion compressor forcing vapor outward from center of rotation, then elbowing bending away from motor and parallel to axis of rotation to enter at the outer extremities of the said disk cavity support where tube/s are attached to said openings opposite one another, whereby vapor is allowed to enter the disk cavity for its return towards center of rotation.

20. The centrifugal heat exchanger of claim 15 wherein said stationary support comprises four quarter section of a cylindrical casing, which also performs as a baffle to channel air movement through both expansion and condensing chambers, whereby said sections straight edges meet at the sides of said stationary support and are secured together at each end by circular walls configurations mediating structural support and stability to the said rotating member, whereby said sections are also secured to a supporting wall at their curved mating edges, wherein said supporting wall mediates between body of said casing and window enclosure with provisional means for adjustable compatibility in window limitation, thereby allowing for a complete environment baffle barrier between the environment being conditioned and environment used as a heat sink, with the expansion chamber in the conditioned environment and the condensing chamber in the heat sink environment, wherein said circular baffle flushes end to end with the inner opening of the said support wall, with said motor mounted to the center area of the condensing chamber end wall, which is the exhaust opening for said chamber having an environmental restraint member across said exhaust opening, likewise air intake openings are located on both sides of the said support wall opening adjacent mounted assembly means with environment restraint members across their openings positioned more under said unit than at the top, which allows for deflection of elements to be shed, whereby said secured casing section encasing the expansion chamber proceeds following said openings to form a double wall baffle within the horn like configuration of its casing to surround said radiating blade impellers which allow channeling of said air through said expansion chamber, where upon said impellers push said air through inset environmental restraints in the facing end wall area comprising also of four radial support arms spaced equally around which stabilizes and supports the more or less flat mediating surface of the control panel and said rotating member.

* * * * *